US007880405B2

(12) United States Patent
Chitta et al.

(10) Patent No.: US 7,880,405 B2
(45) Date of Patent: Feb. 1, 2011

(54) SYSTEM AND METHOD FOR PROVIDING ADJUSTABLE BALLAST FACTOR

(75) Inventors: Venkatesh Chitta, Center Valley, PA (US); Russell L. MacAdam, Coopersburg, PA (US); Kenneth D. Walma, Jr., Philadelphia, PA (US)

(73) Assignee: Lutron Electronics Co., Inc., Coopersburg, PA (US)

( * ) Notice: Subject to any disclaimer, the term of this patent is extended or adjusted under 35 U.S.C. 154(b) by 967 days.

(21) Appl. No.: 11/733,093

(22) Filed: Apr. 9, 2007

(65) Prior Publication Data

US 2008/0246415 A1 Oct. 9, 2008

(51) Int. Cl.
*G05F 1/00* (2006.01)

(52) U.S. Cl. ..... 315/307; 315/209 R; 315/247; 315/291; 315/312; 315/318; 315/DIG. 4

(58) Field of Classification Search ..... 315/209 R, 315/291–294, 307, 308, 312, 316, 318, 224, 315/362, DIG. 4, DIG. 7, 244, 247
See application file for complete search history.

(56) References Cited

U.S. PATENT DOCUMENTS 5,872,429 A 2/1999 Xia
6,817,732 B1 11/2004 Knoble et al.
6,963,178 B1 * 11/2005 Lev et al. ..... 315/307
6,969,955 B2 11/2005 Erickson et al.
7,049,768 B1 5/2006 Zhu
7,224,125 B2 * 5/2007 Ribarich ..... 315/51
7,369,060 B2 * 5/2008 Veskovic et al. ..... 340/825.36
7,575,338 B1 * 8/2009 Verfuerth ..... 362/221
2003/0080696 A1 5/2003 Tang
2005/0179404 A1 8/2005 Veskovic

FOREIGN PATENT DOCUMENTS

EP 1689212 9/2006
WO WO 98/27791 6/1998
WO WO 02/077739 10/2002

* cited by examiner

*Primary Examiner*—Haissa Philogene
(74) *Attorney, Agent, or Firm*—Ostrolenk Faber LLP

(57) ABSTRACT

The invention includes an electronic ballast that is operable to receive a ballast factor setting that enables the ballast to provide a desired ballast factor when the ballast drives a lamp. The electronic ballast includes an input that is adapted to receive a ballast factor setting that represents a desired ballast factor for the ballast and a respective lamp. The ballast further includes a memory that is adapted to store the ballast factor setting, and the ballast includes a processor that uses the ballast factor setting stored in the memory to cause the ballast to provide the desired ballast factor as the ballast drives the lamp. The ballast includes means for substantially preventing subsequently changing the ballast factor setting stored in the memory. Various business methods are further provided as a function of the electronic ballast.

81 Claims, 13 Drawing Sheets

202

Input Currents for 4ft 2Lamp T8 Ballasts at various Ballast Factors

| Ballast Factor | Input Current at 120V | Input Current at 277V |
|---|---|---|
| 1.17 | 660mA | 278mA |
| 1.0 | 580mA | 243mA |
| 0.85 | 500mA | 210mA |

204

Input Currents for 4ft 1Lamp T8 Ballasts at various Ballast Factors

| Ballast Factor | Input Current at 120V | Input Current at 277V |
|---|---|---|
| 1.17 | 338mA | 143mA |
| 1.0 | 298mA | 127mA |
| 0.85 | 262mA | 111mA |

Fig. 2C

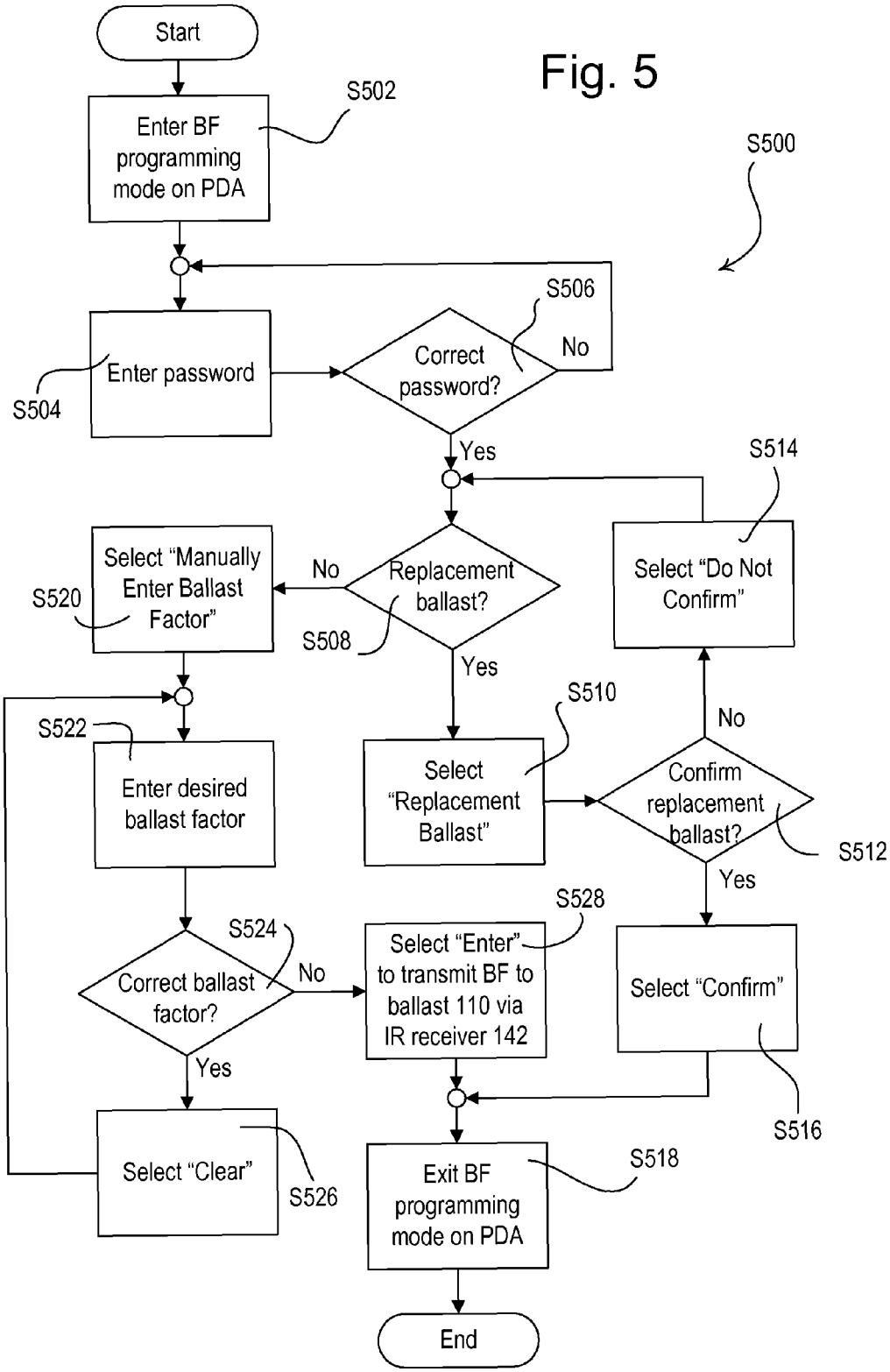
Start
Enter BF programming mode on PDA
S502
Fig. 5
S500
Enter password
S504
Correct password?
S506
No
Yes
S514
Select "Do Not Confirm"
Select "Manually Enter Ballast Factor"
S520
No
Replacement ballast?
S508
Yes
S510
Select "Replacement Ballast"
Confirm replacement ballast?
S512
No
Yes
S522
Enter desired ballast factor
S524
Correct ballast factor?
No
Yes
S528
Select "Enter" to transmit BF to ballast 110 via IR receiver 142
Select "Confirm"
S516
Select "Clear"
S526
Exit BF programming mode on PDA
S518
End

SYSTEM AND METHOD FOR PROVIDING ADJUSTABLE BALLAST FACTOR

BACKGROUND OF THE INVENTION

1. Field of the Invention

The present invention relates, generally, to lighting controls, and, more particularly, to providing a single ballast that is operable to efficiently support a plurality of different fluorescent lamp types.

2. Description of the Related Art

Typically, gas discharge lamps, such as fluorescent lamps, must be driven by ballasts in order to illuminate. An important parameter of an electronic ballast is the ballast factor. The ballast factor is particularly important in the design of a fluorescent lighting system. A typical fluorescent lamp is rated by the manufacturer to provide a rated light output (e.g., measured in lumens) at a rated lamp current. The ballast factor is used to determine the actual maximum possible light output for a particular lamp-ballast combination. As used herein, the ballast factor refers to the ratio of the actual maximum light output of a particular lamp (driven by a particular ballast) to the rated maximum light output of the particular lamp, i.e., $$\text{Ballast Factor} = \frac{\text{Actual maximum lamp output (in lumens)}}{\text{Rated maximum lamp output (in lumens)}}$$

For example, a ballast factor of 1.0 indicates that the maximum amount of light actually provided by a lamp-ballast combination is equal to the possible maximum amount of light output rated by the lamp manufacturer. In the prior art, the ballast factor of a particular ballast is a permanent, unchangeable and fixed value, and is used and relied upon during lighting design calculations.

Moreover, energy efficient lighting design is useful for the design and corresponding energy consumption in buildings and other structures. For example, designers need to know the constraints of devices associated with lighting systems in order to provide appropriate light at all times.

Unfortunately, a ballast having a ballast factor rated for a particular lamp type may not be interchangeable with another lamp type with a different rating. While a single ballast may operate to strike and regulate lamp arc current for two different lamp types, the efficiency of the ballast—particularly with respect to power consumption and relative light output of the two lamps—vastly differs, effectively precluding the possibility of using a single model ballast for a plurality of different lamp types.

In typical prior art lighting control systems, three wires are often used to transmit analog signals (such as phase-control signals) to a master control unit to control lamps and other electrical load devices. Typically, the phase-control signals are transmitted over three wires and enable the dimming of lamps and the controlling of other electrical devices.

More recently, electronic ballasts have been provided with microprocessors, which enable the transmission and reception of digital commands for control of fluorescent lamps. An example of such an electronic ballast is described in commonly-assigned U.S. patent application Ser. No. 10/824,248, filed Apr. 14, 2004, entitled, MULTIPLE-INPUT ELECTRONIC BALLAST WITH PROCESSOR, and U.S. patent application Ser. No. 11/011,933, filed Dec. 14, 2004, entitled DISTRIBUTED INTELLIGENCE BALLAST SYSTEM AND EXTENDED LIGHTING CONTROL PROTOCOL.

The entire disclosures of both applications are incorporated herein by reference. The microprocessors may be programmed to turn the ballasts on and off in response to outputs provided by various sensors, such as occupancy sensors and light sensors. The ballasts may be programmed via wireless infrared ("IR") or radio frequency ("RF") signals, which may include commands to program ballasts to operate individually or in groups, and in response to signals received from photosensors, occupancy sensors or other sources.

The electronic ballasts of a fluorescent lighting control system may transmit and receive commands via a digital ballast communication link using the industry-standard digital addressable lighting interface ("DALI") protocol. Such fluorescent lighting control systems provide significant energy savings by operating in connection with occupancy sensors, supporting daylight harvesting, and implementing load-shedding techniques. Users of such systems by receive tax credits from the government, and other incentives from electric utility companies in connection, for example, with reductions in power consumption per square foot, per light fixture, or per location, or in reductions in total power consumption. Moreover, a business may garner positive good will and good public relations in response to taking active measures to reduce power consumption and implement so-called "green" policies.

As known in the art, a ballast drives a fluorescent lamp by initially establishing a lamp arc current and, thereafter, regulating the arc current to ensure proper operation of the lamp. Each fluorescent lamp is provided with a rated maximum possible light output that is determined by the lamp manufacturer. A respective ballast factor set by the ballast manufacturer directly affects the actual light output for a particular fluorescent lamp. For example, depending upon a respective ballast factor, a forty-watt lamp may produce more light output (e.g., measured in lumens) than a sixty-watt lamp that is driven by a ballast with a lower ballast factor.

Techniques are known for limiting the maximum light output of a fluorescent lamp by adjusting the "high-end trim" of the electronic dimming ballast driving the lamp. The high-end trim defines the maximum light intensity to which the fluorescent lamp may be controlled. The high-end trim is preferably determined by an end user of the ballast. For example, a building manager may program the high-end trim via commands transmitted over the digital ballast communication link. The high-end trim limits the dimming range of the electronic dimming ballast by establishing the maximum value. The dimming range of the electronic dimming ballast is typically rescaled between the high-end trim and a low-end trim (i.e., the minimum intensity to which the fluorescent lamp may be controlled, which is typically off). For example, if the high-end trim of a ballast is set to 75%, the maximum amount of light output available from the fluorescent lamp is effectively limited to 75% of the rated output of the lamp/ballast combination, and the dimming range of the ballast is rescaled between 0% and 75%.

Unlike defining a high-end trim, a ballast factor is typically a non-adjustable, permanently set value that is provided by a ballast manufacturer. In one context, the ballast factor is used by lighting designers, for example, in calculations made during building lighting design. From an input standpoint, the ballast factor represents (and affects) power consumption. The input factor, as known in the art, represents an amount of power consumption by a load and is proportional to the ballast factor. Lighting designers rely upon the ballast factor of each respective ballast to calculate the amount of light output that a fixture will produce. Further, the ballast factor is used by designers, for example, to determine an appropriate number of lighting fixtures and the corresponding light output therefor. Accurate knowledge of these and other variables enables the designer to make significant cost savings decisions, such as to eliminate one or more lighting fixtures.

In addition to lighting designers, other parties have a particular interest in power consumption variables that are considered during the design and manufacture of a building or other structure. For example, parties with a particular interest in power consumption, such as specialists informed of building and electrical codes (e.g., the National Electric Code or NEC), also use ballast factors to calculate expected energy use and consumption.

Because high-end trim values can be changed by end users, for example, using hand-held programming devices or making selections on a master control unit, building lighting designers do not take the high-end trim value set by an end user into account during the lighting design process. Similarly, electrical code review personnel do not consider high-end trim values when determining or assessing an estimated amount of power that a building is expected to use. High-end trim values are relatively easy to change, and parties who are provided with relatively low levels of authorization may be able to set or modify the high-end trim value associated with a lighting fixture. In view of the possibility that a high-end trim value can be modified, particularly by parties having relatively low security authorization levels, lighting designers and electrical code review personnel do not rely upon high-end trim values for building lighting design and accurate estimates of expected energy consumption.

Recently, lighting fixtures have been designed with improved reflective properties that increase efficiency and ensure corresponding reductions in energy consumption. For example, by increasing the reflective property of a lighting fixture, only 90% of power may be required to provide the same light output as a similar lighting fixture that is not provided with improved reflective properties. Accordingly, a ballast configured with a ballast factor of 0.90 can be substituted for a ballast configured with ballast factor of 1.0, which provides a corresponding reduction of power that is required for the associated light output. Unfortunately, replacing one ballast having a first ballast factor rating with another ballast having a different ballast factor rating can be very expensive.

In order to accommodate substituting a first ballast with a first ballast factor with a second ballast having a second, different ballast factor in the prior art, two physically separate ballasts must be provided and installed. Although different ballasts may have respective ratings, each ballast is accordingly rated with a respective ballast factor. Thus, lighting designers are constrained to designing building lighting by predetermined ballasts and/or fixtures that combine lamps with ballasts.

Typically, building lighting designers are constrained by various specifications, including reconciling a desired amount of light output with physical limitations in connection with individual ballasts, each configured with a single, permanent ballast factor. This and other constraints experienced by building lighting designers often negatively impact the lighting design process, and, ultimately, the lighting system of a building, because various features desired by a lighting designer may be cost-prohibitive, impractical or both. This may be, for example in case a ballast having a particular ballast factor that is desired by a building lighting designer must be procured by a special order.

Ballast manufacturers typically only make available ballasts in a limited number of ballast factors. Thus, customers can only obtain a limited number of ballast factors for a ballast/lamp configuration.

In addition to various constraints imposed on lighting designers, such as described above, prior art ballasts having a fixed and permanent ballast factor may be difficult or even impossible to replace. Occasionally, specially ordered ballasts, each having a custom ballast factor, such as 0.73, are purchased to accommodate a unique lighting design and build project. Eventually, one or more of the ballasts may fail and need to be replaced. Replacing the custom ballast may be difficult, or very expensive, in the case where the original manufacturer is no longer in business, is not available, or otherwise not manufacturing a ballast having the same custom ballast factor.

FIG. 1 is a diagram illustrating an example of the parties associated with designing, manufacturing and distributing lighting control systems, specifically, fluorescent lighting control systems including ballasts, in connection with the design and construction of a building 10. A building lighting designer 12 designs lighting for one or more areas in the building 10, which is owned by a customer 14. The lighting designer 12 is typically provided with preferred building specifications and provides lighting designs that attempt to comply with the specifications. Typically, the lighting designers 12 are constrained by physical and technical limitations of ballasts, particularly with respect to ballast factors and rated light output associated with a particular lamp and ballast combination. The lighting designer 12 determines a ballast (which is characterized by a desired ballast factor) and a lighting fixture (including a fluorescent lamp type) to use.

The customer 14 may then purchase the ballast directly from a ballast manufacturer 16, or as part of the lighting fixture from an original equipment manufacturer ("OEM") 18. If the customer 14 places an order for the ballast from a customer service department 20 of the ballast manufacturer 16, the ballast manufacturer ships the ballast directly to the building 10. The ballast manufacturer 16 may have a warehouse 22 or other facility for manufacturing ballasts, and/or for storing the ballasts. If the customer 14 buys the ballast directly from the ballast manufacturer 16, the customer 14 also places an order for the desired lighting fixture with a customer service department 24 of the OEM 18 and the OEM ships the lighting fixture from a warehouse 26 to the building 10. Accordingly, a third party, such as an electrical contractor 28, installs the ballast and the lighting fixture together in the building.

Alternatively, the OEM 18 may provide the ballasts installed in the lighting fixtures that the OEM ships. The OEM 18 preferably orders the ballasts from the ballast manufacturer 16 and stores the ballasts in the warehouse 26. The customer 14 may place an order for the ballast and the lighting fixture from the OEM 18, which then installs the ballast in the lighting fixture and ships the lighting fixture from the warehouse 26 to the building 10. The electrical contactor 28 installs the lighting fixture with the ballast in the building 10.

The ballast manufacturer 16 may employ or otherwise control field service personnel 30 who configure and service the ballasts and the lighting control system in the building 10. The field service personnel 30 travel to the building 10 and service the ballasts, i.e., configure and maintain the ballasts and associated fluorescent lighting control systems. The customer 14 may be trained, for example, by the field service personnel 30, in one or more applications associated with the fluorescent lighting control system. Alternatively, the customer 14 may be authorized to configure the ballasts, such as to define the high-end trim, the low-end trim, occupancy levels, grouping of devices or the like, rather than the field service personnel 30.

Electrical code review personnel 32 review technical specifications and lighting designs, for example, to assess whether a building design complies with building regulations and codes, such as energy efficiency regulations, wiring codes, etc., as defined by state and local governments. The electrical code review personnel 32 may also determine whether a particular building lighting design operates in compliance with power companies' credits and benefits in connection with load shedding.

Since the customer 14 can only order ballasts having a limited number of ballast factors from the ballast manufacturer 16 or the OEM 18, the lighting designer 12 must design the lighting system of the building 10, specifically, the types and locations of the lamps, fixtures, and ballasts, based on these limited numbers of ballast factors. Thus, compromises in the light output or the energy consumption of the lighting system must be made when selecting one of the limited number of ballast factors.

Therefore, there is a need for a method of offering ballasts having any ballast factor desired by the lighting designer 12 and the customer 14.

SUMMARY OF THE INVENTION

The present invention provides a method of providing to a customer a fluorescent dimming ballast having a desired ballast factor, where the ballast is adapted to drive a predetermined lamp type. The method comprises the steps of: (1) receiving a request for the ballast adaptable to be configured with the desired ballast factor; (2) providing the ballast; and (3) configuring the ballast to have the desired ballast factor. The desired ballast factor is substantially prevented from subsequently being adjusted.

According to another embodiment of the present invention, a method of configuring a ballast factor of a fluorescent dimming ballast comprises the steps of: (1) receiving an input representative of a desired ballast factor; and (2) configuring the ballast to have the desired ballast factor, the desired ballast factor substantially prevented from subsequently being adjusted.

The present invention further provides an electronic dimming ballast for driving a gas discharge lamp. The ballast is characterized by a ballast factor and comprises an inverter, a resonant tank, a controller, a memory, and an input. The inverter is operable to convert a substantially DC bus voltage to a high-frequency AC voltage having an operating frequency and an operating duty cycle. The resonant tank is operable to couple the high-frequency AC voltage to the lamp to generate a present lamp current through the lamp. The controller is operable to control the inverter to control the current through the lamp. The memory is coupled to the controller and is operable to store the ballast factor. The input is coupled to the controller and is operable to receive a signal representative of a desired ballast factor. The controller is operable to store the desired ballast factor in the memory in response to receiving the signal representative of the desired ballast factor.

According to another embodiment of the present invention, an electronic dimming ballast for driving a gas discharge lamp and characterized by a ballast factor comprises means for receiving an input representative of a desired ballast factor, and means for configuring the ballast to have the desired ballast factor. The desired ballast factor is substantially prevented from subsequently being adjusted.

According to yet another embodiment of the present invention, an electronic ballast is characterized by a ballast factor and is operable to drive a gas-discharge lamp in accordance with the ballast factor. The ballast comprises an input adapted to receive a first ballast factor setting that represents a first desired ballast factor for the ballast and the lamp; a memory adapted to store the first ballast factor setting; and a processor operable to use the first ballast factor setting stored in the memory to cause the ballast to provide the first desired ballast factor as the ballast drives the lamp.

In addition, the present invention provides a method of configuring a ballast to provide a desired ballast factor when the ballast drives a lamp. The method comprises the steps of: (1) transmitting a first ballast factor setting to an input provided with the ballast, wherein the first ballast factor setting represents a first desired ballast factor for the ballast and a respective lamp; (2) storing the first ballast factor setting in a memory provided with the ballast; and (3) processing the first ballast factor setting stored in the memory by a processor provided with the ballast to cause the ballast to provide the first desired ballast factor as the ballast drives the lamp.

The present invention further provides a method of supplying a lighting fixture. The method comprises the steps of: (1) receiving by a first party a request from a customer for the lighting fixture having a ballast that provides a desired ballast factor; (2) assembling by the first party the lighting fixture provided with the ballast; (3) configuring the ballast with the desired ballast factor; and (4) supplying by the first party the lighting fixture with the configured ballast to the customer.

Other features and advantages of the present invention will become apparent from the following description of the invention that refers to the accompanying drawings.

BRIEF DESCRIPTION OF THE DRAWINGS

For the purpose of illustrating the invention, there is shown in the drawings a form, which is presently preferred, it being understood, however, that the invention is not limited to the precise arrangements and instrumentalities shown. The features and advantages of the present invention will become apparent from the following description of the invention that refers to the accompanying drawings, in which:

FIG. 2C illustrates input current tables for ballast for two different lamp types at three ballast factors in accordance with an embodiment of the present invention;

FIG. 5 is a flowchart of a handheld remote control ballast factor adjustment procedure, which uses a handheld remote control to adjust the ballast factor of the ballast of FIG. 2B according to the present invention;

DETAILED DESCRIPTION OF EMBODIMENTS OF THE INVENTION

Figure 1:
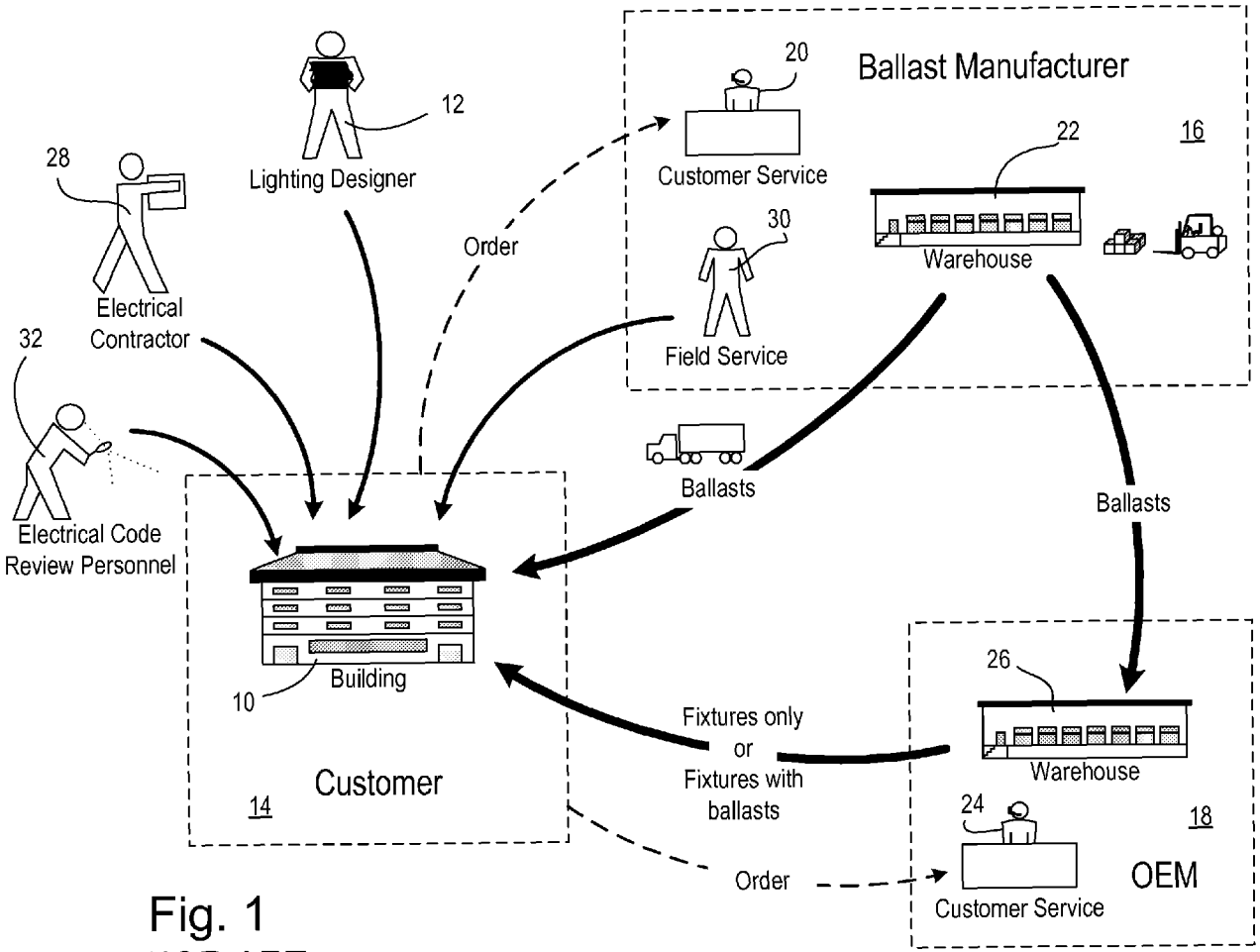
Fig. 1 PRIOR ART
FIG. 1 is a diagram illustrating designing, manufacturing and distributing ballasts in connection with designing and constructing a building.

The foregoing summary, as well as the following detailed description of the preferred embodiments, is better understood when read in conjunction with the appended drawings. For the purposes of illustrating the invention, there is shown in the drawings an embodiment that is presently preferred, in which like numerals represent similar parts throughout the several views of the drawings, it being understood, however, that the invention is not limited to the specific methods and instrumentalities disclosed.

Figure 2A:
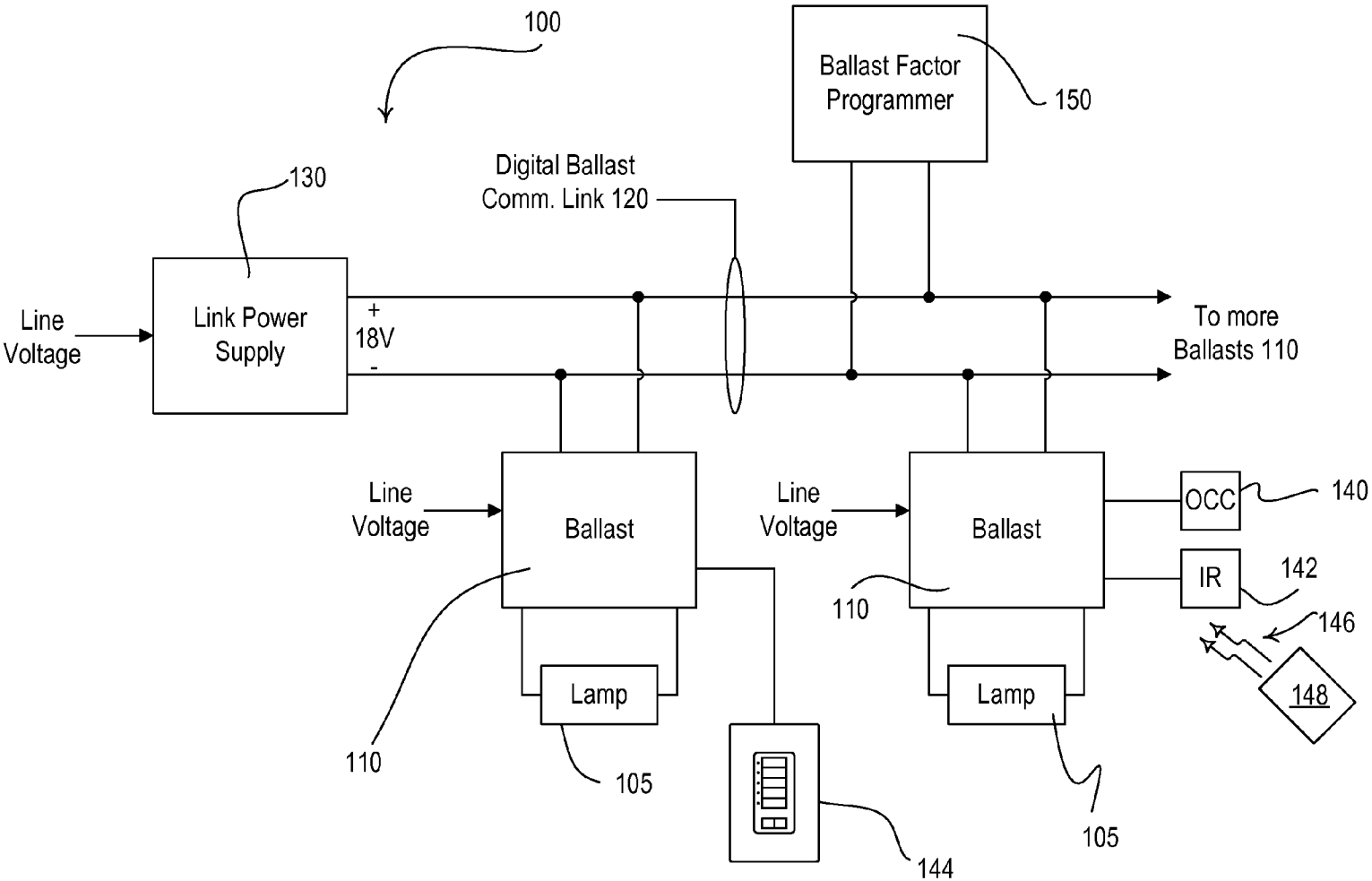
FIG. 2A shows a simplified block diagram of a lighting control system including a digital electronic ballast having an adjustable ballast factor according to the present invention.

FIG. 2A is a simplified block diagram of a fluorescent lighting control system 100 including digital electronic ballasts 110, which each have an adjustable ballast factor according to the present invention. Each of the ballasts 110 is coupled to a fluorescent lamp 105 for controlling the intensity of the lamp. The lighting control system 100 includes a digital ballast communication link 120 (e.g., a DALI communication link), which is coupled to the ballasts 110 and a link power supply 130. The ballasts 110 are each coupled to an alternating-current (AC) mains line voltage and control the amount of power delivered to the lamps 105 to thus control the intensities of the lamps. The digital ballast communication link 120 may be coupled to more ballasts 110, for example, up to 64 ballasts.

The power supply 130 receives line voltage and generates the DC link voltage $V_{LINK}$ (e.g., 18 $V_{DC}$) for the communication link 120. When no messages are being transmitted on the communication link 120, the link floats high in an idle state. The ballasts preferably use Manchester encoding to communicate with the other ballasts on the communication link 120. To transmit a logic one value, the ballasts 110 short the conductors (i.e., electrically connect) of the communication link 120 to cause the communication link to transition from the idle (high) state to a shorted (low) state. To transmit a logic zero value, the ballasts 110 cause the communication link 120 to transition from the shorted state to the idle state. Therefore, the ballasts 110 are operable to transmit digital messages by alternating the communication link 120 between the shorted state and the idle state.

Each ballast 110 is operable to receive a plurality of inputs from, for example, an occupancy sensor 140, a daylight sensor (not shown), an infrared (IR) receiver 142, and a wallstation 144, and to subsequently control the intensities of the lamps 105 in response. The IR receiver 142 may receive IR signals 146 from a handheld remote control 148, such as, for example, a personal digital assistant (PDA), which includes an IR transmitter (not shown), i.e., a communication circuit. The handheld remote control 148 may use a graphical user interface (GUI) software to allow a user to easily program the ballast 110. An example of the method of using a handheld remote control to configure the ballasts 110 is described in greater detail in co-pending commonly-assigned U.S. patent application Ser. No. 11/375,462, filed Mar. 13, 2006, entitled HANDHELD PROGRAMMER FOR LIGHTING CONTROL SYSTEM, the entire disclosure of which is hereby incorporated by reference. Alternatively, the ballast 110 may comprise an RF receiver (not shown) and the handheld remote control 148 could transmit RF signals to the RF receiver of the ballast.

The link power supply 130 preferably builds and maintains a database containing all of the parameters of each of the ballasts 110 coupled to the digital ballast communication link 120. The parameters of the ballasts may comprise the high-end trim, the low-end trim, the type of and number of lamps connected to the ballast, the rated input voltage, a link address of the ballast, and a serial number of the ballast. The link power supply 130 preferably transmits a query message to each of the ballasts 110 for each of the ballast parameters. As the ballasts 110 respond to the query messages, the link power supply 130 builds the database of ballast parameters. The method of building the database of ballast parameters is described in greater detail in U.S. Patent Provisional Application No. 60/858,844, filed Nov. 14, 2006, entitled LIGHTING CONTROL SYSTEM, the entire disclosure of which is hereby incorporated by reference.

A ballast factor programmer 150 may be coupled to the ballasts 110 via the digital communication link 120. The ballast factor programmer 150 is operable to transmit digital signals to the ballast 110 to adjust the ballast factor of the ballasts as will be described in greater detail below.

Figure 2B:
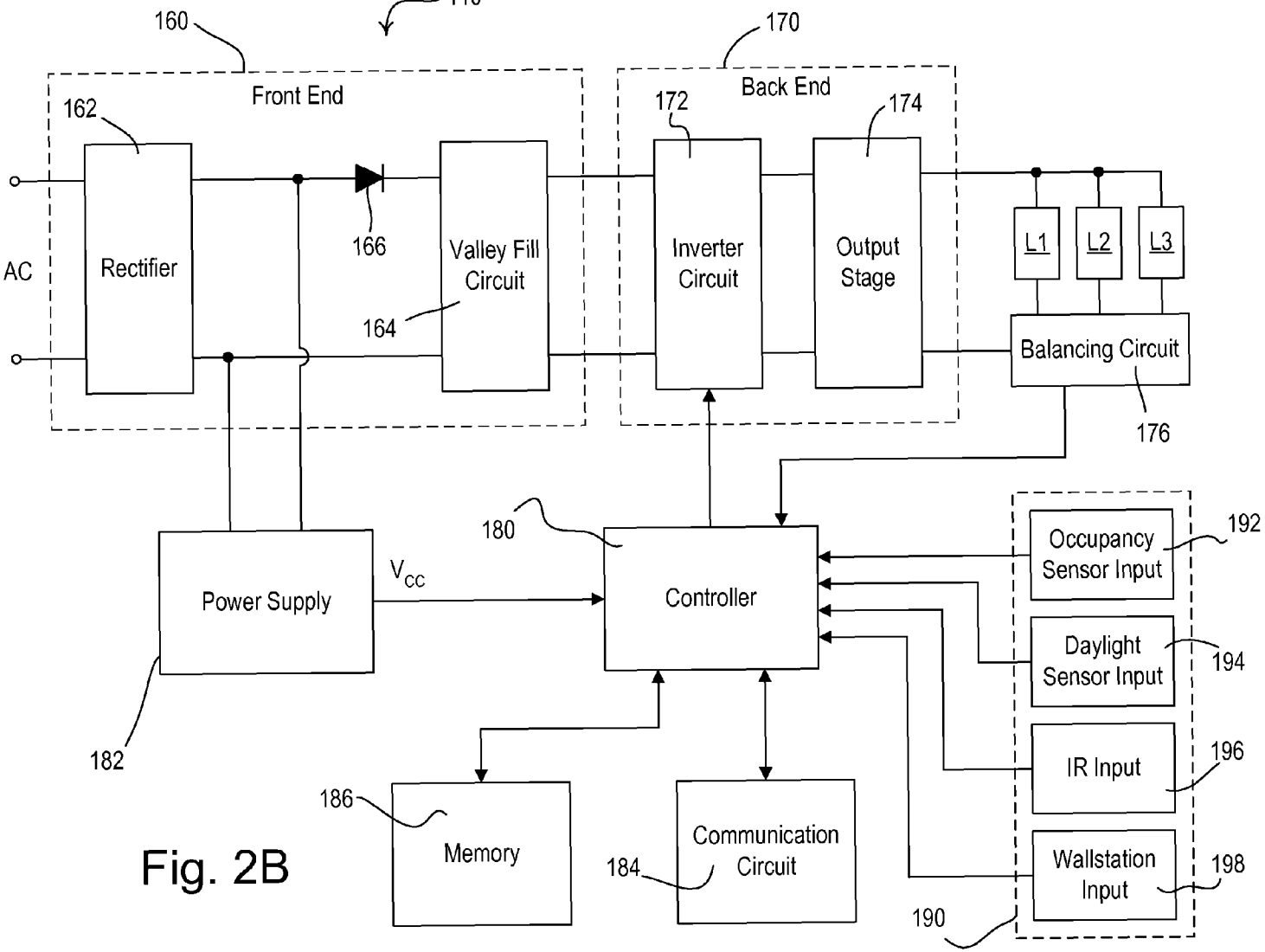
FIG. 2B is a simplified block diagram of the digital electronic ballast of FIG. 2A.

FIG. 2B is a simplified block diagram of the digital electronic dimming ballast 110. As shown in FIG. 2B, the ballast 110 drives three fluorescent lamps L1, L2, L3 in parallel. Electronic ballasts typically can be analyzed as comprising a front end 160 and a back end 170. The front end 160 may include power factor correction means (not shown) so that the ballast 110 presents a predominantly resistive load to the line voltage means. The front end 160 typically includes a rectifier 162 for generating a rectified voltage from an alternating-current (AC) mains line voltage, and a filter circuit, for example, a valley-fill circuit 164, for filtering the rectified voltage to produce a direct-current (DC) bus voltage. The valley-fill circuit 164 is coupled to the rectifier 162 through a diode 166 and includes one or more energy storage devices that selectively charge and discharge so as to fill the valleys between successive rectified voltage peaks to produce a substantially DC bus voltage. The DC bus voltage is the greater of either the rectified voltage or the voltage across the energy storage devices in the valley-fill circuit 164.

The back end 170 typically includes an inverter 172 for converting the DC bus voltage to a high-frequency AC voltage and an output circuit 174 comprising a resonant tank circuit for coupling the high-frequency AC voltage to the lamp electrodes. A balancing circuit 176 is provided in series with the three lamps L1, L2, L3 to balance the currents through the lamps and to prevent any lamp from shining brighter or dimmer than the other lamps. The front end 160 and back end 170 of the ballast 110 are described in greater detail in commonly-assigned U.S. Pat. No. 6,674,248, issued Jan. 6, 2004, entitled ELECTRONIC BALLAST, the entire disclosure of which is hereby incorporated by reference.

A controller 180 generates drive signals to control the operation of the inverter 172 so as to provide a desired load current to the lamps L1, L2, L3. The controller 180 is operable to control the intensity of the lamps L1, L2, L3 from a low-end (i.e., determined by the low-end trim) to a high-end (i.e., determined by the high-end trim). The controller 180 is preferably implemented as a microcontroller, but may be any suitable processing device, such as a programmable logic device (PLD), a microprocessor, or an application specific integrated circuit (ASIC). The balancing circuit 176 is operable to provide a control signal to the controller 180 if one or more of the lamps L1, L2, L3 are missing or faulty. The balancing circuit 176 is described in greater detail in U.S. patent application Ser. No. 11/120,229, filed May 2, 2005, entitled ELECTRONIC BALLAST HAVING MISSING LAMP DETECTION, the entire disclosure of which is hereby incorporated by reference.

A power supply 182 is connected across the outputs of the rectifier 162 to provide a DC supply voltage, $V_{CC}$, which is used to power the controller 180. A communication circuit 184 is coupled to the controller 180 and allows the controller 180 to communicate with the other ballasts 110 on the digital ballast communication link 120. The controller 180 is also coupled to a memory 186 for storage of the ballast factor and other ballast parameters, such as, for example, a link address of the ballast, the high-end trim, and the low-end trim. Preferably, the memory 186 comprises an electrically erasable programmable read-only memory ("EEPROM"). The memory 186 may be locked and unlocked, which is a standard feature of EEPROMs.

The ballast 110 further comprises a plurality of inputs 190 including an occupancy sensor input 192, a daylight sensor input 194, an IR input 196, and a wallstation input 198. The controller 180 is coupled to the plurality of inputs 190 such that the controller 180 is responsive to the occupancy sensor 140, the daylight sensor, the IR receiver 142, and the wallstation 144 of the lighting control system 100.

As noted above, there is a need in the art for the ballast 110 to be configurable to support one of a plurality of ballast factors. According to the present invention, the ballast 110 stores the ballast factor in the memory 186, such that the ballast factor can be configured in response to received user commands, e.g., from commands received via the communication circuit 184 (i.e., the digital ballast communication link 120) or via the IR input 196 (i.e., the IR receiver 142). The ballast factor of the ballast 110 is preferably "locked", such that the ballast factor is substantially prevented from being changed as will be described in greater detail below. Unlike prior art ballasts in which an unalterable ballast factor is set by a manufacturer, the ballast 110 according to the present invention is operable to receive a ballast factor value and operate with the new ballast factor represented by the value.

According to another aspect of the present invention, the ballast 110 is operable to receive a value that represents a ballast factor, even if the ballast 110 is already configured with a different ballast factor. The ballast 110 operates in connection therewith until, for example, the ballast is reconfigured and the ballast factor value is replaced by another one. This preferably occurs by flashing the memory 186, as known in the art.

Preferably, once the ballast 110 is configured with a respective ballast factor, the ballast 110 is "locked" or otherwise substantially prevented from being updated with a new ballast factor unless particular steps are taken to reconfigure the ballast 110 preferably by authorized personnel. Since the ballast factor is stored in the memory 186, which is an electrically erasable programmable read-only memory, boot loading the ballast 110, as known in the art, will not reset or otherwise erase the ballast factor setting previously configured in the ballast 110. Further, and as described in greater detail below, the ability to change the 110 ballast factor of a ballast is preferably secured, for example, by password protection. Thus, configuring or reconfiguring the ballast 110 with a particular ballast factor is procedurally different than, for example, defining the high-end trim for the ballast 110.

In one embodiment, the ballast factor for the ballast 110 is predefined by the manufacturer of the ballast. The ballast 110 can, thereafter, receive a new ballast factor value to update the ballast factor for the ballast 110. The ability for the ballast factor of the ballast 110 to be modified is not implemented in a non-secure fashion, however, but instead is implemented in a control locking system and is otherwise invariant to the typical user.

In accordance with the present invention, the ballast 110 is operable to be customized for particular lamps, for example for respective input currents or other internal parameters for the lamps that are defined by the lamps' respective manufacturers. In a preferred embodiment, a table of respective input currents is provided with the ballast 110, such as on a physical label placed on the ballast 110 and/or provided in a technical specification that is distributed with the ballast 110 or provided in an electronic format, such as posted on the Internet.

In accordance with a preferred embodiment, the label or other documentation associated with the ballast 110 includes a table of input currents for one or more lamps and for a plurality of ballast factors. FIG. 2C illustrates two input current tables 202, 204 that each represent ballast input current levels for two respective lamps at three ballast factors (0.85, 1.0 and 1.17). Table 202 lists input currents for a fixture comprising a combination of two four-foot T8 lamps and a ballast. For example, at 120V, the fixture's input current is 580 milliamps ("mA") when the ballast factor of the ballast 110 is 1.0. In the case when the ballast factor is 1.17, then at 120V the fixture's input current is 660 mA. Thus, and as indicated in tables 202, 204, from an input standpoint, the ballast factor affects power consumption.

The present invention frees the lighting designers 12 from the prior art constraints, particularly in connection with limitations associated with the limited ballast factors that are offered by the ballast manufacturers 16. The lighting designers 12 can now submit and implement lighting designs that comply with building specifications, meet energy efficiency standards or the like, without sacrificing light output and without having to add or remove fixtures. Unlike the prior art, the lighting designers 12 can now specify a particular ballast factor that supports the lighting design. Ballast manufacturers can now provide ballasts having specified ballast factors without having to fabricate custom ballasts that may be very expensive and difficult to replace. Thus, the present invention represents a vast improvement over prior art lighting design operations, in which lighting controls constrained by hardware limitations govern, at least in part, a particular lighting design. The present invention enables the reverse to occur, in which the lighting design governs, at least in part, the hardware requirements, including the ballast factor.

As noted above, the ballast 110 of the present invention supports virtually an unlimited number of custom lighting configurations because a preferred ballast factor can be specified by the lighting designer 12 (or other party) and programmed into the ballast 110, as described herein. Accordingly, the ballast 110 is preferably provided with documentation that identifies the ballast factor in connection with one or more lamps. As noted above, for example, a label is printed and adhered to the ballast 110 such that one installing or servicing the ballast 110 or corresponding lighting fixture can easily identify the ballast factor.

The ballast 110 can be configured with a ballast factor at various times and by specially authorized and trained personnel. For example, the field service personnel 30 may configure the ballast 110 to have a specific ballast factor after installation. The field service personnel 30 may then provide documentation that lists the respective ballast factor setting for each ballast 110. Alternatively, an OEM 18 may configure the ballast 110 with a respective ballast factor prior to shipping the configured ballast 110 to the customer 14 or other party. In another alternative, the ballast 110 may be configured with a respective ballast factor by the ballast manufacturer 16, such as at the warehouse 22.

Figure 3:
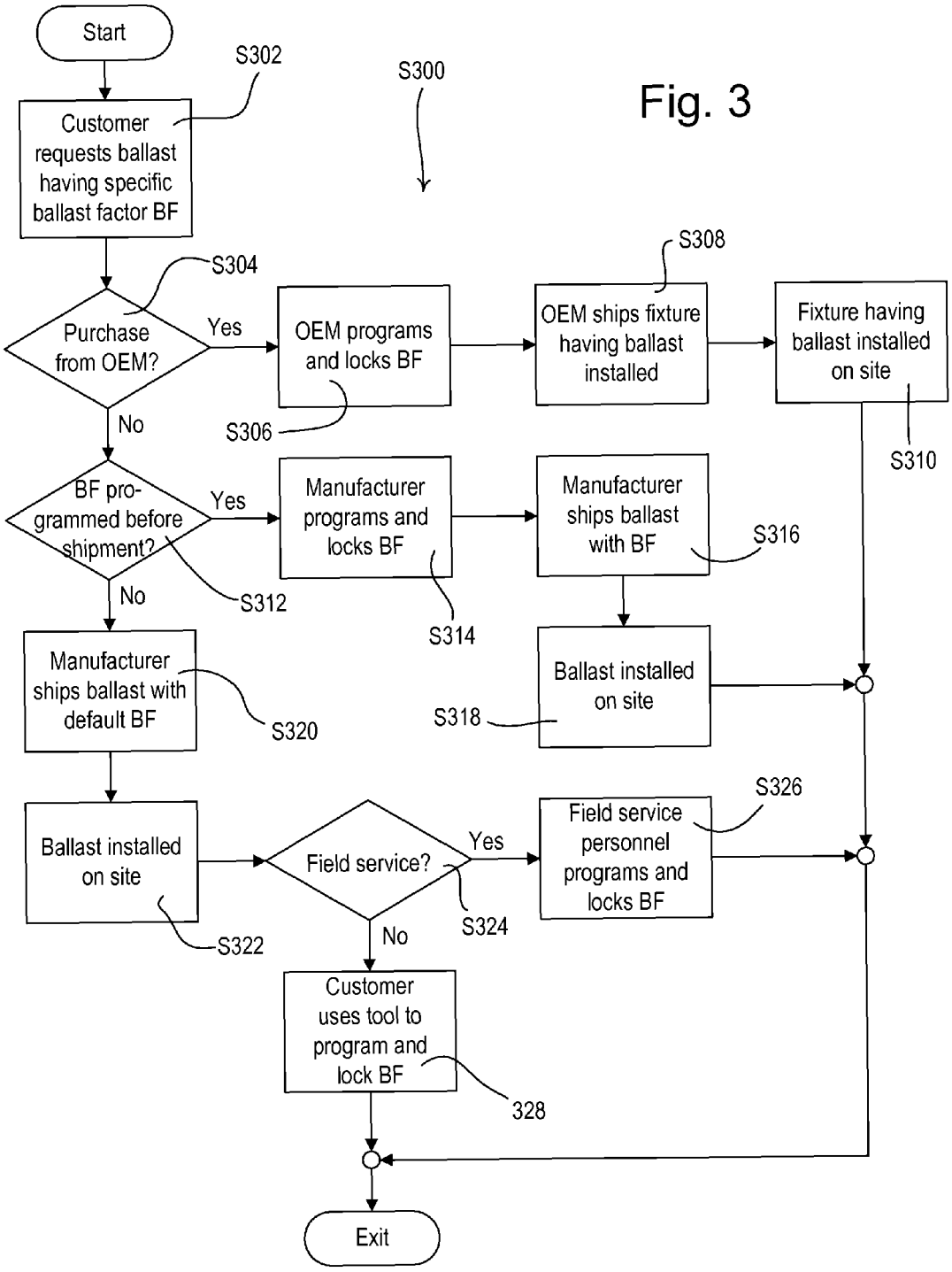
FIG. 3 is a flowchart of a business method of providing a ballast having a desired ballast factor according to the present invention.

FIG. 3 is a flowchart of a business method S300 of providing a ballast 110 having a desired ballast factor according to the present invention. At step S302, a lighting designer 12 generates lighting designs of the fluorescent lighting control system of the building 10 and requests the ballasts 110 that have the desired ballast factor. Accordingly, the customer 14 may order the ballasts having the desired ballast factor directly from the ballast manufacturer 16 or the OEM 18.

If the customer 14 orders the ballast from the OEM 18 at step S304, the OEM 18 programs the ballast with the desired ballast factor and locks the ballast factor at step S306. The OEM 18 preferably need not stock more than one model of a ballast 110 since the ballast 110 can be configured with countless ballast factors. Preferably, the ballast manufacturer 16 provides the OEM 18 with a tool (i.e., the ballast factor programmer 150) for programming the ballast with the desired ballast factor, e.g., using a programmer ballast factor adjustment procedure S400, which will be described in greater detail below with reference to FIG. 4B. At step S308, the OEM 18 installs the ballasts 110 in the desired lighting fixtures, documents the ballast factor (e.g., on a label adhered to the ballast 110, in the documentation that accompanies the ballast 110, on the Internet, or any combination thereof), and ships the ballast 110 to the customer 14. The lighting fixture having the ballast 110 is installed in the building 10 by the electrical contractor 28 at step S310.

If the customer 14 does not order the ballast from the OEM 18 at step S304, then the customer orders the ballast directly from the ballast manufacturer 16. As with the OEM 18, the ballast manufacturer 16 need not stock more than one model of the ballast 110. If the ballast 110 should be programmed with the desired ballast factor by the ballast manufacturer 16 prior to shipment at step S312, the ballast manufacturer configures the ballasts 110 with the desired ballast factor and locks the ballast factor at step S314 (e.g., by executing the programmer ballast factor adjustment procedure S400 using the ballast factor programmer 150). Further, the ballast manufacturer 16 documents the ballast factor (e.g., on a label adhered to the ballast 110, in documentation that accompanies the ballast 110, on the Internet, or any combination thereof) and ships the ballast 110 to the customer 14 at step S316. The customer 14 receives the ballast 110 and the electrical contractor 28 installs the ballast in the lighting fixture (that was provided by the OEM 18) at step S318. If the ballast factor should not be programmed prior to shipment at step S310, the ballast manufacturer 16 ships the ballast 110 without the ballast factor programmed (e.g., with a default ballast factor of 1.0) at step S320 and the ballast 110 is installed at the building 10 by the electrical contractor 28 at step S322.

If the field service personnel 30 of the ballast manufacturer 16 should at step S324 configure the ballast factor of the ballast 110 after the ballast is installed (at step 322), the field service personnel programs the ballast factor of the installed ballasts 110 at step S326. The field service personnel 30 may use the ballast factor programmer 150 with the programmer ballast factor adjustment procedure S400 to adjust the ballast factor of the ballast 110. Alternatively, the field service personnel 30 may use the GUI software running on the handheld remote control 148 (e.g., a PDA) to modify the ballast factor of the ballast 110 as part of a handheld remote control ballast adjustment procedure S500, which will be described in greater detail below with reference to FIG. 5.

In one embodiment, the field service personnel 30 reviews technical documentation or information that is available and that discloses the ballast factor in order to determine the desired ballast factor. If the ballast 110 shipped at step S320 is replacing a previously-installed ballast of the fluorescent lighting control system of the building 10 (i.e., the shipped ballast is a replacement ballast), the field service personnel 30 may instruct the ballast 110 to automatically determine the ballast factor, for example, by using the handheld remote control ballast factor adjustment procedure S500. Accordingly, the ballast is operable to determine the ballast factor of the previously-installed ballast and to use this ballast factor as the ballast factor for the replacement ballast as will be described in greater detail below. Preferably, the ballast factor value of the ballasts 110 is stored in the memory 186 of each of the ballasts and/or in a database in the link power supply 130. This ballast factor value is used to configure the ballast factor of the replacement ballast 110 with the appropriate ballast factor.

If the field service personnel 30 are not to program the ballast factor at step S324, the customer 14 programs the ballast factor of the ballasts 110 at step S328 using, for example, the handheld remote control ballast factor adjustment procedure S500, or alternatively, a "low-tech" programming method S600, which will be described in greater detail with reference to FIG. 6. Alternatively, if the ballast 110 is a replacement ballast, the customer 14 may instruct the ballast 110 to automatically determine the ballast factor.

When the ballast factor is programmed by the ballast manufacturer 16 or the OEM 18 prior to shipment of the ballast 110, the ballast manufacturer 16 and the OEM preferably use the ballast factor programmer 150 to program the ballast factor of the ballasts. Further, the field service personnel 30 may use the ballast factor programmer 150 to simultaneously program the ballast factors of all of the ballasts 110 of the lighting control system 100 after the ballasts have been installed in the building 10.

Figure 4A:
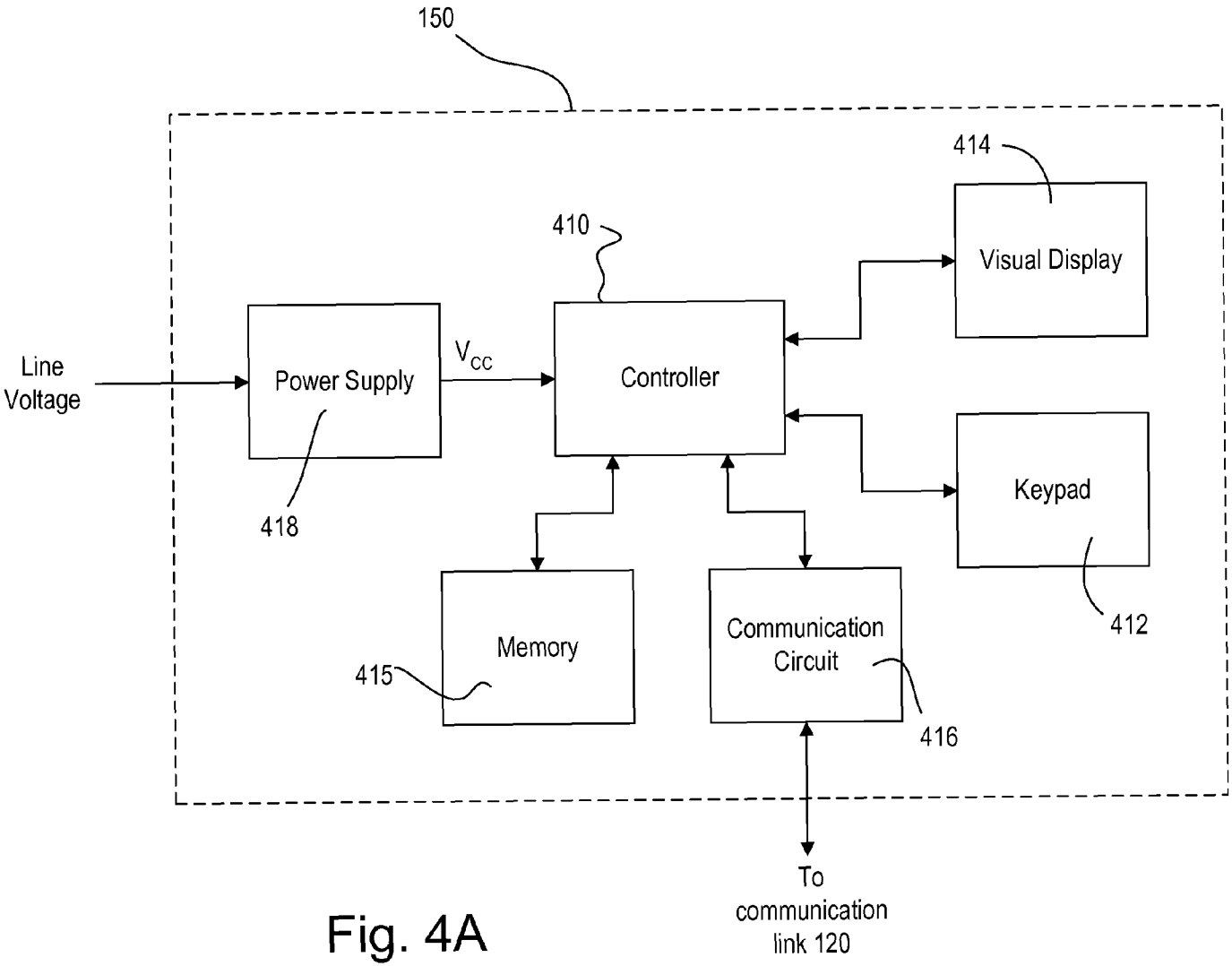
FIG. 4A is a simplified block diagram of a ballast factor programmer of the lighting control system of FIG. 2A.

FIG. 4A is a simplified block diagram of the ballast factor programmer 150 according to the present invention. The ballast factor programmer 150 preferably includes a controller 410 for controlling the operation of the ballast factor programmer. The controller 410 is preferably implemented as a microcontroller, but may be any suitable processing device, such as a programmable logic device (PLD), a microprocessor, or an application specific integrated circuit (ASIC).

The ballast factor programmer 150 also comprises a keypad 412 (e.g., a numeric keypad), which is coupled to the controller 410, such that the controller is operable to receive user inputs representative of the desired ballast factor. Preferably, the keypad includes at least ten numeric buttons (representing the digits zero through nine), an enter button (to be pressed when the desired ballast factor has been entered using the numeric buttons), and a clear button (to clear the presently-entered ballast factor and start over). The controller 410 is also coupled to a visual display (e.g., two adjacent seven-segment displays) to display the desired ballast factor indicated by the inputs provided by the keypad 412. The controller 410 is operable to store the desired ballast factor in a memory 415 and to transmit the desired ballast factor as part of a digital signal across the digital ballast communication link 120 via a communication circuit 416. The ballast factor programmer 150 further comprises a power supply 418 operable to receive line voltage and generate a DC voltage $V_{CC}$ for powering the controller 410, and other parts of programmer 150.

Figure 4B:
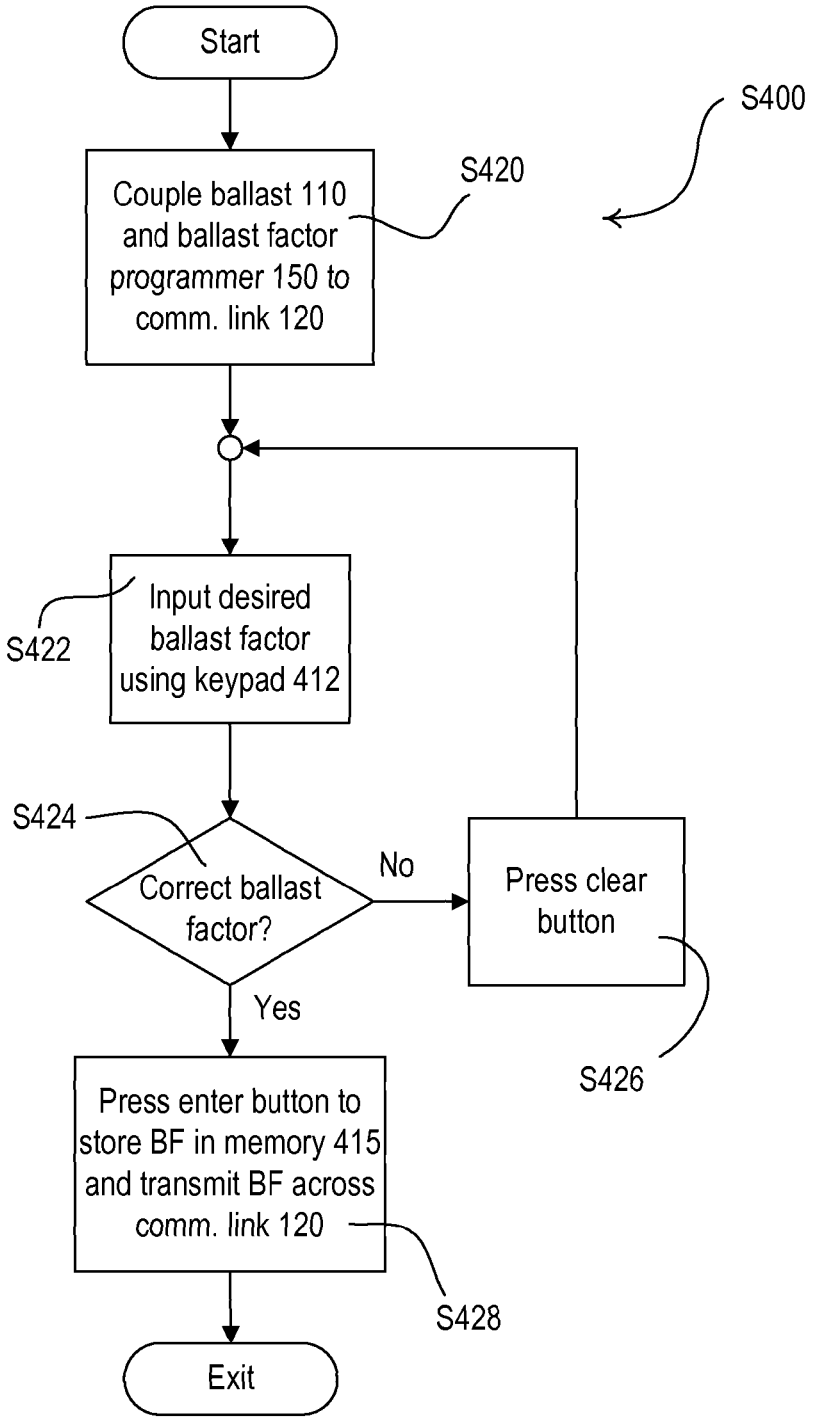
FIG. 4B is a flowchart of a programmer ballast factor adjustment procedure, which uses the ballast factor programmer of FIG. 4A to adjust the ballast factor of the ballast of FIG. 2B according to the present invention.

FIG. 4B is a flowchart of the programmer ballast factor adjustment procedure S400, which uses the ballast factor programmer 150 to adjust the ballast factor of the ballast 110 according to the present invention. The programmer ballast factor adjustment procedure S400 is typically executed by the ballast manufacturer 16 or the OEM 18 to program the ballast factor of the ballast 110 using the ballast factor programmer 150 prior to shipping the ballast to the customer 14, but may also be executed by the field service personnel 30 after the ballast is installed.

First, the ballast 110 and the ballast factor programmer 150 are coupled to the digital ballast communication link 120 at step S420. The desired ballast factor is then entered using the keypad 412 of the ballast factor programmer 150 at step S422. If the correct ballast factor has not been entered at step S424, the clear button of the keypad 412 is pressed at step S426 and the desired ballast factor can be reentered at step S422. If the correct ballast factor has been entered at step S424, the enter button of the keypad 412 is pressed at step S428. The desired ballast factor that was entered at step S422 is stored in the memory 415 and is transmitted across the digital ballast communication link 120. Accordingly, the ballast 110 receives the digital message containing the desired ballast factor and stores the desired ballast factor in the memory 186, which will be described in greater detail below.

FIG. 5 is a flowchart of the handheld remote control ballast factor adjustment procedure S500, which uses the handheld remote control 148 to adjust the ballast factor of the ballast 110 according to the present invention. The handheld remote control ballast factor adjustment procedure S500 is typically executed by the field service personnel 30 or the customer 14 after the ballasts 110 are installed in the building 10. Preferably, the handheld remote control ballast factor adjustment procedure S500 is implemented using a graphical user interface (GUI) software provided on a PDA, e.g., the handheld remote control 148. Alternatively, the GUI software may be provided on a personal computer (PC), which may be operatively coupled to the digital ballast communication link 120 as described in previously-referenced U.S. Provisional Patent Application No. 60/858,844.

At step S502, the user enters a ballast factor programming mode ("BF-programming mode") using the GUI software running, for example, on the PDA. The GUI software prompts the user for a password and the user enters the password at step S504. If the password is incorrect at step S506, the user is able to enter the password again at step S504.

If the password is correct at step S506, the procedure S500 continues on and the user is able to decide at step S508 whether the ballast factor should be automatically determined (such as, for example, when the ballast 110 is a replacement ballast) or alternatively if the ballast factor should be manually entered. If the ballast 110 is a replacement ballast at step S508, the user selects "Replacement Ballast" using the GUI software at step S510. The user is then given the option to confirm that the ballast is a replacement ballast at step S512, i.e., the GUI software warns the user that the ballast factor is about to be changed. If the user does confirm that the ballast 110 is a replacement ballast at step S510, the user selects "Do Not Confirm" using the GUI software at step S514. If the user confirms that the ballast is a replacement ballast at step S510, the user selects "Confirm" using the GUI software at step S516 and the PDA transmits an IR signal containing a "replacement ballast" command to the ballast 110. Accordingly, the ballast 110 queries the link power supply 130 for the ballast factor and receives the ballast factor from the link power supply. The ballast 110 then stores and locks the ballast factor. Finally, the user exits the BF programming mode using the GUI software at step S518.

If the ballast 110 is not a replacement ballast at step S508, the user selects "Manually Enter Ballast Factor" using the GUI software at step S520 and then manually enters the desired ballast factor at step S522. Next, the user is prompted to confirm that the entered ballast factor is correct at step S524, i.e., the GUI software provides a warning screen to inform the user that the ballast factor of the ballast 110 is about to be changed. If the desired ballast factor is incorrect at step S524, the user may select "Clear" using the GUI software at step S526 and reenter the desired ballast factor at step S522. If the desired ballast factor is correct at step S524, the user selects "Enter" using the GUI software at step S514 and the PDA transmits the desired ballast factor to the ballast 110 via the IR receiver 142. The user then exits the BF programming mode using the GUI software at step S518.

Figure 6:
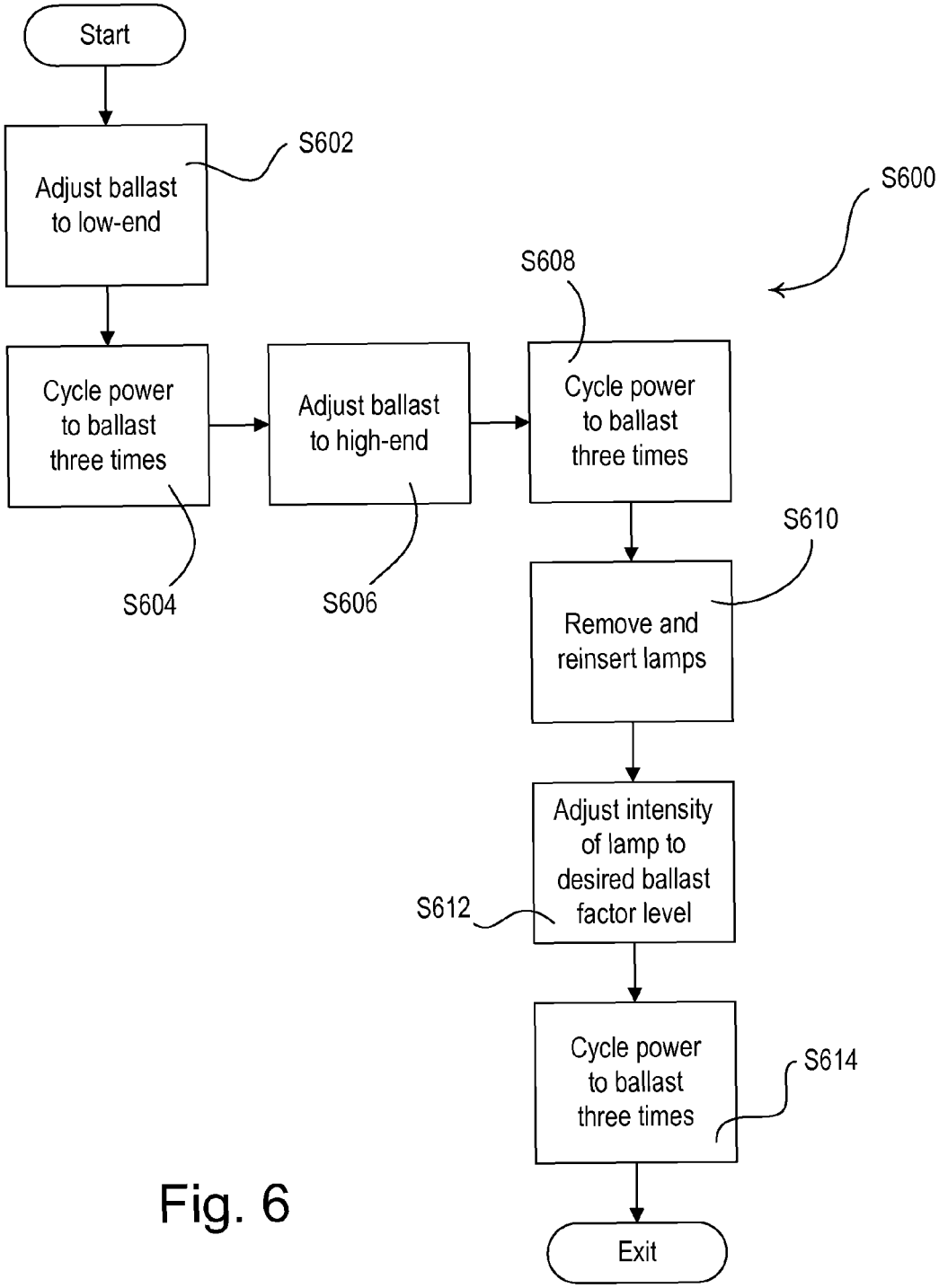
FIG. 6 is a flowchart of a "low-tech" ballast factor adjustment procedure, which does not require the ballast factor programmer or the handheld remote control.

FIG. 6 is a flowchart of the low-tech ballast factor adjustment procedure S600 for configuring the ballast factor of the ballast 110 in accordance with an alternative embodiment of the present invention. In the low-tech ballast factor adjustment procedure S600, the ballast 110 is configured with a respective ballast factor without the aid of the ballast factor programmer 150 or the handheld remote control 148 (via the IR receiver 142). Instead, the low-tech ballast factor adjustment procedure S600 enables the ballast 110 to be configured with the desired ballast factor by controlling the intensity of the connected lamp to an intensity representative of the desired ballast factor and then cycling power to the lamp a predetermined number of times.

At step S602, the ballast 110 is adjusted to low-end, i.e., the lamp connected to the ballast is controlled to the minimum intensity. At step S604, power is cycled to the ballast three times, i.e., power to the ballast is removed and then immediately restored three times. Next, the ballast 110 is adjusted to high-end, i.e., the lamp connected to the ballast is controlled to the maximum intensity at step S606, and power is cycled to the ballast three times at step S608. At step S610, the lamps are removed, and then reinserted to provide another level of security.

Next, the ballast 110 is ready to be configured with the desired ballast factor. The intensity of the lamp coupled to the ballast 110 is controlled to an intensity that represents the desired ballast factor at step S612, and power is cycled to the ballast three times at step S614. Accordingly, the ballast 110 programs the present intensity as the new ballast factor and flashes the lamp to signal that the new ballast factor has been accepted. For example, if the ballast factor is presently 1.0 and the ballast is controlled to 85% of the dimming range during step S612, the new ballast factor is 0.85 at step S614. Thereafter, the ballast 110 operates with the new ballast factor and is unchangeable again, until, for example, steps described in the flowchart shown in FIG. 6 are repeated.

The low-tech ballast factor adjustment procedure S600 provides a plurality of levels of security in order to change the ballast factor of the ballast 110. For the first and second levels of security, the ballast 110 must either be at low-end or high-end while power to the ballast is cycled three times. For the third level of security, the lamps must subsequently be removed and then reinstalled. Finally, power to the ballast 110 must be cycled three consecutive times again in order to program the new ballast factor.

Since the low-tech ballast factor adjustment procedure S600 can only adjust the ballast factor of the ballast 110 to an intensity in the dimming range of the ballast, the low-tech ballast factor adjustment procedure S600 cannot increase the value of the ballast factor.

Figure 7:
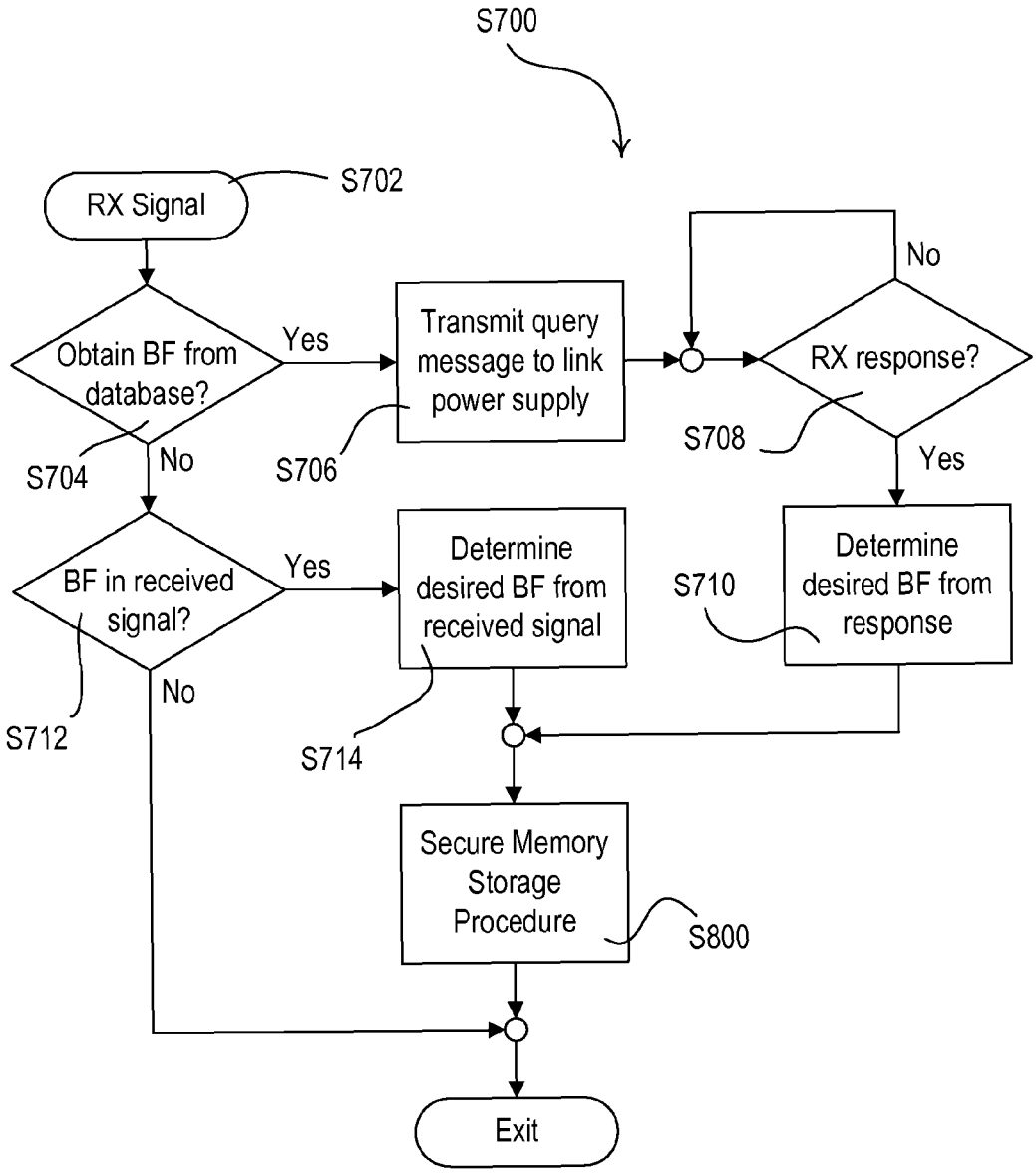
FIG. 7 is a flowchart of a signal receiving procedure executed by a controller of the ballast of FIG. 2B to adjust the ballast factor in response to the ballast factor programmer or the handheld remote control.

FIG. 7 is a flowchart of a signal receiving procedure S700 executed by the controller 180 of the ballast 110 to adjust the ballast factor in accordance with a preferred embodiment of the present invention. In the signal receiving procedure S700 of FIG. 7, the ballast 110 is configured electronically by receiving at step S702 a signal via the digital ballast communication link 120 (i.e., from the ballast factor programmer 150) or the infrared (IR) receiver 142 (i.e., from the handheld remote control 148). The received signal may contain the desired ballast factor to be stored in the memory 186 or a command to automatically determine the ballast factor from the database of ballast parameters stored in the link power supply 130, i.e., a "replacement ballast" command.

If the controller 180 receives a command to automatically determine the ballast factor from the database in the link power supply 130 at step S704, the ballast 110 transmits a query message to the link power supply at step S706. The signal receiving procedure S700 waits until a response from the link power supply 130 is received at step S708, at which time the controller 180 determines at step S710 the desired ballast factor of the ballast 110 from the response message. If the controller 180 has not received a command to automatically determine the ballast factor at step S704, but the desired ballast factor is part of the received signal at step S712, the controller determines the desired ballast factor from the received signal at step S714.

Once the controller 180 has determined the new desired ballast factor of the ballast 110, the controller executes a secure memory storage procedure S800 to store the desired ballast factor in the memory 186. Thereafter, the ballast 110 operates with a new ballast factor and is unchangeable again, until, for example, steps described in the flowchart shown in FIG. 7 are repeated.

Figure 8:
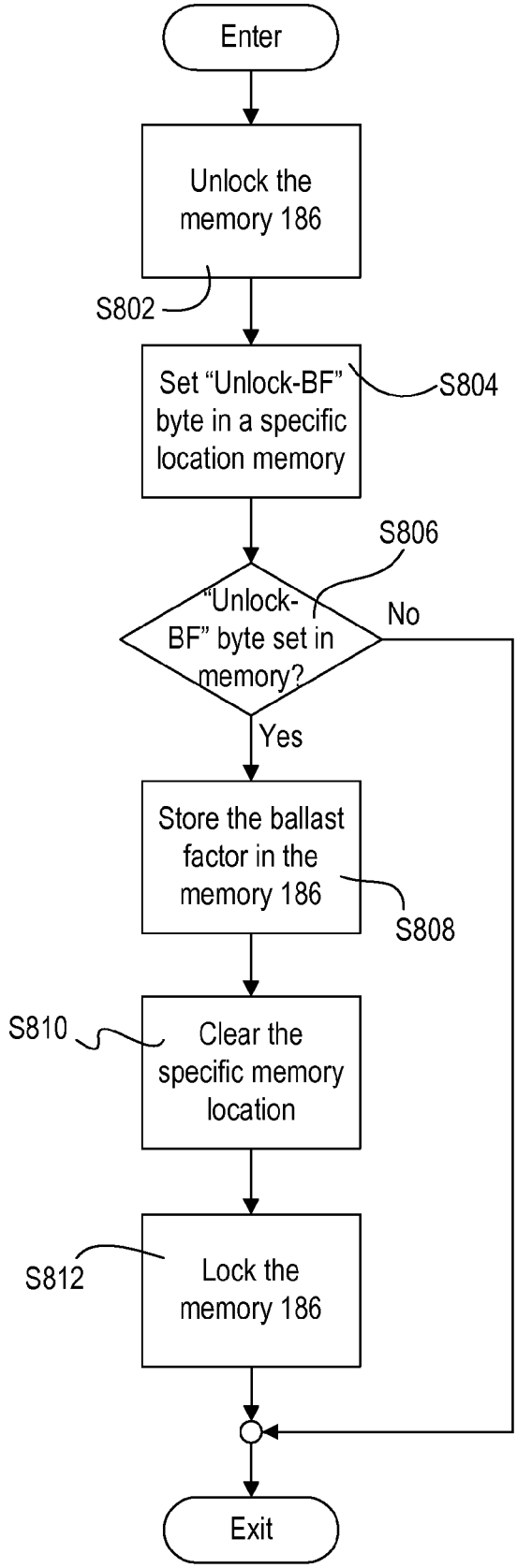
FIG. 8 is a flowchart of a secure memory storage procedure executed by the controller of the ballast of FIG. 2B to store a new ballast factor in a memory of the ballast.

FIG. 8 is a flowchart of the secure memory storage procedure S800. At step S802, the controller 180 unlocks the memory 186 of the ballast 110. At step S804, an Unlock-BF byte (i.e., a specific value representing a "password" or special code required to unlock the ballast factor value in the memory 186) is stored in a specific memory location of the memory. For example, a "password" value of 0xFA (hexadecimal) may be stored in a specific memory location of 0xFF (hexadecimal). Once the Unlock-BF byte is set, a determination is made at step S806 as to whether the value in the specific memory location is set to the value of the Unlock-BF byte. If not, the secure memory storage procedure S800 simply exits. If the Unlock-BF byte is stored in the correct memory location at step S806, the ballast 110 is configured to receive a new ballast factor value. At step S808, the controller 180 stores the desired ballast factor in the memory 186. The controller 180 then clears the specific memory location (which was set to the Unlock-BF byte at step S804) at step S810 and locks the memory 186 at step S812.

Figure 9A:
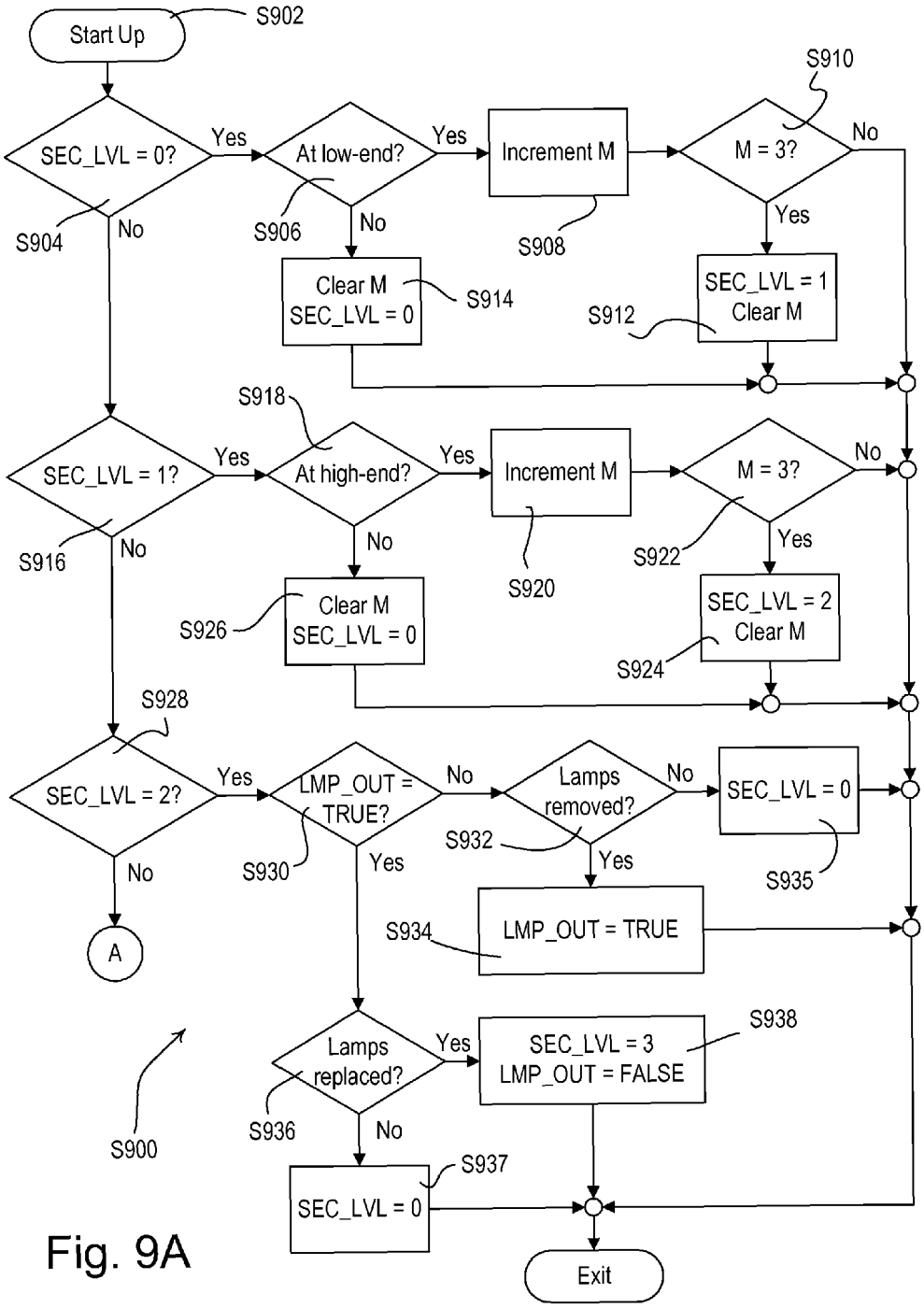
FIGS. 9A and 9B are flowcharts of a start-up procedure executed by the controller of the ballast of FIG. 2B to adjust the ballast factor as part of the low-tech ballast factor adjustment procedure of FIG. 6.
Figure 9B:
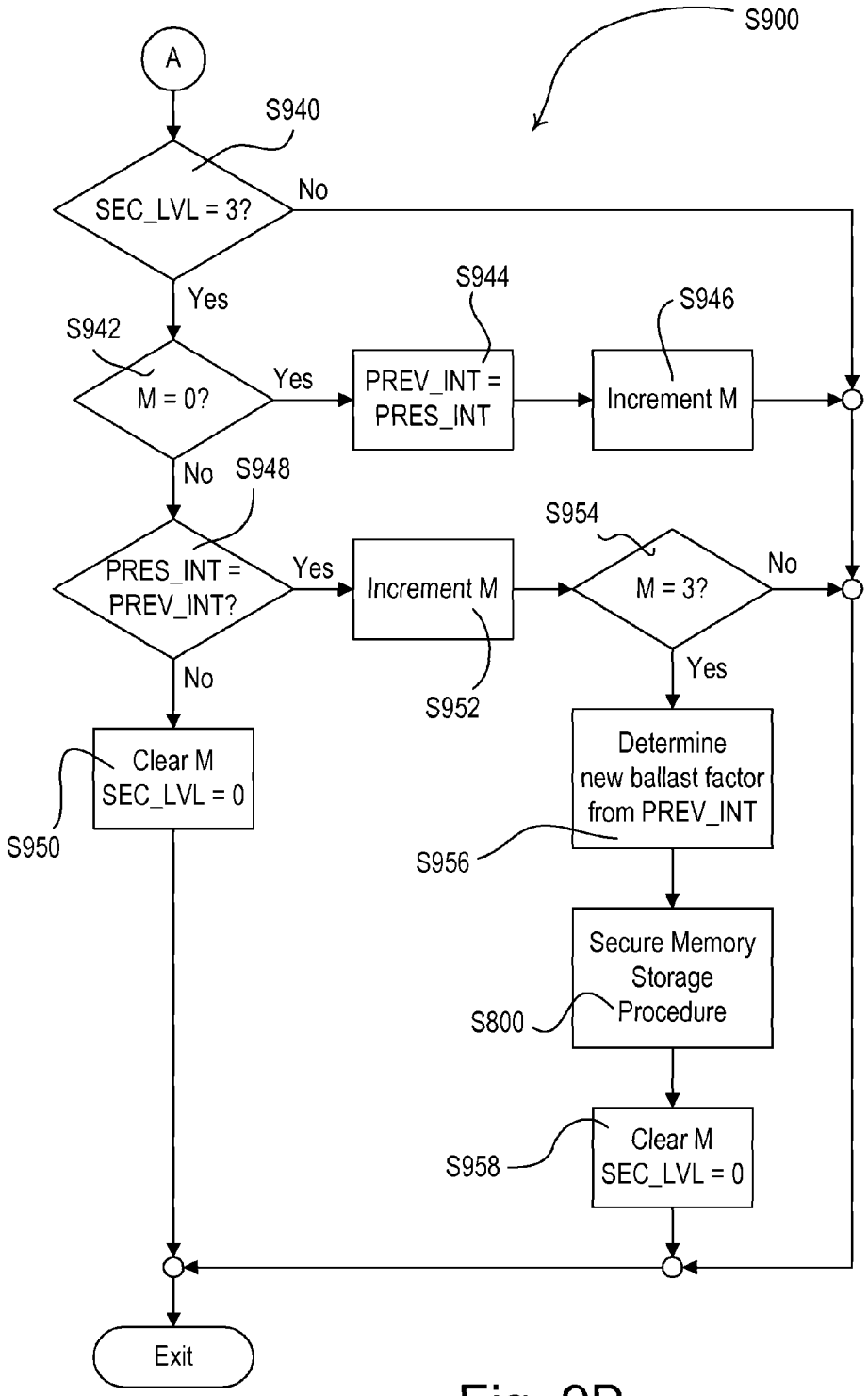

FIGS. 9A and 9B are flowcharts of a start-up procedure S900 executed by the controller 180 of the ballast 110 to adjust the ballast factor as part of the low-tech ballast factor adjustment procedure S600 of FIG. 6. The start-up procedure S900 begins at step S902 at start-up of the controller 180, i.e., when the controller is unpowered and then power is applied to the controller. Accordingly, whenever power is cycled to the ballast 110, e.g., during the low-tech ballast factor adjustment procedure S600, the start-up procedure S900 is executed before the controller 180 begins normal operation.

The start-up procedure S900 uses a variable SEC_LVL to determine at which point in the low-tech ballast factor adjustment procedure S600 (i.e., at what level of security) that the ballast 110 is operating in. For example, the variable SEC_LVL is set to one (1) after power is cycled to the ballast 110 three times while the ballast is at low-end, i.e., after the first level of security. The start-up procedure S900 also uses a variable M to keep track of how many times that power to the ballast 110 is cycled during each level of security.

Referring to FIG. 9A, when the variable SEC_LVL is equal to zero (0) at step S904, the controller 180 operates to determine if power is cycled to the ballast 110 three times while the ballast is at low-end. Specifically, if the ballast 110 is at low-end at step S906, the variable M is incremented by one at step S908. If the variable M is equal to three (3) at step S910, the variable SEC_LVL is set to one (1) and the variable M is cleared at step S912. If the variable M is not equal to three (3) at step S910, the procedure S900 simply exits and the controller 180 begins normal operation. If the variable SEC_LVL is equal to zero (0) at step S904, but the ballast 110 is not at low-end at step S906, the variable M is cleared and the variable SEC_LVL is set to zero (0) at step S914.

If the variable SEC_LVL is not equal to zero (0) at step S904, but is equal to one (1) at step S916, the controller 180 determines if the ballast is maintained at high-end while power is cycled three times. If the ballast 110 is at high-end at step S918, the variable M is incremented by one at step S920. If the variable M is equal to three (3) at step S922, the variable SEC_LVL is set to two (2) and the variable M is cleared at step S924. Otherwise, the procedure S900 simply exits. If the ballast 110 is not at high-end at step S918, the variable M is cleared and the variable SEC_LVL is set to zero (0) at step S926.

If the variable SEC_LVL is not equal to zero (0) or one (1), but is equal to two (2) at step S928, the controller 180 now determines if the lamps are removed and then replaced before moving onto the next level of security. The controller 180 uses a variable LMP_OUT to keep track of when the lamps are removed. If the variable LMP_OUT is not set to TRUE at step S930 (i.e., the lamps have not been previously removed), a determination is made at step S932 as to whether the lamps are presently removed from the sockets of the lighting fixture. If so, the variable LMP_OUT is set to TRUE at step S934 and the procedure S900 exits. If the lamps are not removed at step S932, the variable SEC_LVL is set to zero (0) at step S935 and the procedure S900 exits.

If the variable LMP_OUT is set to TRUE at step S930 (i.e., the lamps have been previously removed), but the lamps have not been replaced at step S936, the variable SEC_LVL is set to zero (0) at step S937 and the procedure S900 exits. However, when the lamps are replaced at step S936, the variable SEC_LVL is set to three (3) and the variable LMP_OUT is set to FALSE at step S938 and the procedure S900 exits.

Referring to FIG. 9B, if the variable SEC_LVL is equal to three (3) at step S940, the controller 180 is ready to receive a new ballast factor. Accordingly, the user is able to adjust the intensity of the lamps coupled to the ballast 110 to an intensity representative of the desired ballast factor, and then cycle power to the ballast three times. The controller 180 uses a variable PRES_INT to store the present intensity of the lamps and a variable PREV_INT to store the previous intensity of the lamps, i.e., the intensity of the lamps the last time that power was cycled to the ballast 110.

If the variable M is equal to zero (0) at step S942 (i.e., after the first time that the power is cycled to the ballast after the variable SEC_LVL is set to four), the variable PREV_INT is set equal to the variable PRES_INT at step S944 and the variable M is incremented at step S946. If the variable M is not equal to zero (0) at step S942, a determination is made at step S948 as to whether the variable PRES_INT is equal to the variable PREV_INT, i.e., whether the intensity of the lamp has changed since the last time that power was cycled to the ballast 110. If the intensity has changed at step S948, the variable M is cleared and the variable SEC_LVL is set to zero (0) at step S950 and the procedure S900 exits.

If the variable PRES_INT is equal to the variable PREV_INT at step S948, the variable M is incremented at step S952. If the variable M is not equal to three (3) at step S954, the procedure S900 simply exits. If the variable M is equal to three (3) at step S954, the intensity of the lamp has stayed at the same intensity while the power was cycled to the ballast 110 three times. Accordingly, a new ballast factor is determined at step S956 from the present intensity of the ballast 110, for example, using the equation $$\text{New Ballast Factor}=(BF)\times(PREV_INT),$$

where BF is the value of the old ballast factor and PREV_INT is the value of the variable PREV_INT. Next, the new ballast factor is stored in the memory 186 using the secure memory storage procedure S800 shown in FIG. 8. Finally, the variable M is cleared and the variable SEC_LVL is set to zero (0) at step S958 and the procedure S900 exits.

One skilled in the art will recognize that the precise steps in FIGS. 3-9 are illustrative and represent embodiments of the present invention, which can be modified without departing from the spirit of the present invention or from the scope of protection defined herein.

In accordance with one aspect of the invention, a ballast 110 having an adjusted or reconfigured ballast factor does not affect the performance or responsiveness of a lamp coupled to the ballast. For example, a ballast 110 configured with a new ballast factor effectively re-scales the dimming range of the ballast. Thus, a ballast 110 that has a reconfigured ballast factor of 0.85 will provide up to 85% of the light output rated by the lamp manufacturer. Controlling a ballast 110 configured with a ballast factor of 0.85 to intensities between 0-100% will cause the lamp to illuminate from off to 85% of the rated output.

In addition, the present invention preferably supports a plurality of business methods that are implemented, at least in part, as a function of the ballast 110. For example, the ballast manufacturers 16 can work with lighting designers 12 to create a new method for lighting designs because, unlike in the prior art, a ballast factor can be ordered for ballasts 110. Further, a plurality of ballast factors can be ordered for a plurality of ballasts 110. The ballast manufacturer 16 can charge a fee to the lighting designer 12 and/or customer 14 for use of the new lighting design method.

Further, the lighting designer 12 (or other specifier) can specify that only ballasts that have the ability to be configured with a respective ballast factor (such as the ballast 110) to be used in a particular building project. By placing this requirement on a particular lighting control system 100, the lighting designer may ensure that the lighting control system will perform as designed. From the point of view of the ballast manufacturer, the ballasts 110 can be sold at a premium price, particularly in view of the added functionality and flexibility that the ballast 110 provides.

In addition to selling the ballasts 110, the ballast manufacturer 16 can charge fees for replacing ballasts 110, for example, via the field service personnel 30. Instead of merely replacing a ballast the field service personnel 30 can use the present invention to determine a previous ballast's ballast factor setting, and configure a new ballast 110 with the previous ballast's ballast factor. Alternatively, new ballast factors can be provided either for currently installed or existing ballasts 110, or for new ballasts 110. For example, a building 10 may be configured with new lighting fixtures that have substantially improved reflective properties. By providing improved reflective properties in, for example a fixture upgrade, a substantial reduction in power can be achieved without sacrificing the total light output of the fixture. Accordingly, the ballasts 110 can be reconfigured with a new ballast factor, or new ballasts 110 with a new ballast factor setting can be installed. The customers 14 will realize substantial power cost savings as a function of the new fixtures and new ballast factor, and will accordingly invest in service fees that are attributable to configuring the ballasts 110 with new ballast factors. Further, the customer 14 will realize reductions in energy costs by load shedding and will enjoy tax credits and other positive reinforcement measures received from a power company in connection with reductions in power consumption per square foot, per light fixture and per location.

In another business method provided in accordance with the present invention, the OEM 18 has incentive to pay a premium to the ballast manufacturers 14 for ballasts 110 because the ballast operates to make the best use of the individual lighting fixture characteristics as a function of the adjustable ballast factor. In other words, the present invention relieves the OEM 18 from concerns of obtaining a ballast that has a suitable ballast factor for the lighting fixture. Instead, the OEM 18 configures the ballast 110 to support any ballast factor that is suitable and/or appropriate for the respective lighting fixture manufactured by the OEM 18.

Moreover, the OEM 18 may enter into one or more business partnerships with the ballast manufacturer 16 and the OEM 18 may charge the customer 14 a premium fee for service associated with the ballast 110. The OEM 18 will realize improved profitability in connection with the ballast 110, as customers will pay additional fees for lamp fixtures outfitted with ballast 110. The OEM 18 may elect to partner with the ballast manufacturer 16 by paying the ballast manufacturer a percentage of each ballast 110 sold in connection with a particular fixture, for all ballasts 110 sold in connection with any fixture, or some other arrangement.

Thus, the ballast 110 having an adjustable ballast factor according to the present invention provides numerous benefits over prior art ballasts. A single ballast 110 is operable to support virtually any kind of fixture or design for a particular lamp, and can be customized either prior to shipment or after shipment of the fixture. The lighting designers 12 can create new designs that can be implemented using the ballast 110 of the present invention without a need for ordering a plurality of prior art ballasts that have permanent and respective ballast factors. Energy codes that enforce limits, for example, on watts per square foot and total lighting wattage can be met as a function of the ballast factor of ballast 110 trimming down energy consumption. Further, energy credits and the like issued by power companies are attainable as a function of the adjustable ballast factor provided in connection with ballast 110.

Further, the ballast 110 of the present invention preferably supports new business methods in which ballast 110 can be configured, for example, at the site where lighting fixtures are installed in a building for a fee. Furthermore, original equipment manufacturers can provide the ballast 110 of the present invention with a predefined and customized ballast factor for a particular building lighting design.

Although the present invention has been described in relation to particular embodiments thereof, many other variations and modifications and other uses will become apparent to those skilled in the art. For example, the ballast 110 according to the present invention can be implemented in load types other than dimming fluorescent lamps. For example, the present invention is applicable to non-dimming ballasts 110, light emitting diodes ("LEDs"), high-intensity discharge lighting ("HID") or the like.

It is preferred, therefore, that the present invention not be limited by the specific disclosure herein.

What is claimed is:

1. A method of providing to a customer a fluorescent dimming ballast having a desired ballast factor, the ballast adapted to drive a predetermined lamp type, the method comprising the steps of:

receiving a request for the ballast adaptable to be configured with the desired ballast factor;

providing the ballast; and configuring the ballast to have the desired ballast factor by transmitting a digital signal including the desired ballast factor to the ballast, and storing the desired ballast factor in a memory of the ballast;

wherein the desired ballast factor is substantially prevented from subsequently being adjusted.

2. The method of claim 1, further comprising the step of:

shipping the ballast to the customer prior to the step of configuring the ballast to have the desired ballast factor.

3. The method of claim 2, wherein the step of configuring occurs at a facility of the customer.

4. The method of claim 3, wherein the step of configuring is performed by a field service personnel of a manufacturer of the ballast.

5. The method of claim 4, wherein the step of configuring is performed using a handheld remote control.

6. The method of claim 1, wherein the step of configuring is performed by a manufacturer of the ballast.

7. The method of claim 6, wherein the step of configuring occurs at a facility of the customer.

8. The method of claim 7, wherein the step of configuring is performed by a field service personnel of the manufacturer of the ballast.

9. The method of claim 6, wherein the step of configuring occurs at a facility of a manufacturer of the ballast.

10. The method of claim 1, wherein the step of configuring is performed by an original equipment manufacturer.

11. The method of claim 10, wherein the step of configuring is performed at a facility of an original equipment manufacturer.

12. The method of claim 1, further comprising the step of:

shipping the ballast to the customer after the step of configuring the ballast to have the desired ballast factor.

13. The method of claim 12, wherein the step of configuring takes place at a facility of an original equipment manufacturer.

14. The method of claim 13, wherein the step of configuring is performed using a tool provided by a manufacturer of the ballast.

15. The method of claim 10, wherein the step of configuring is performed using a tool provided by a manufacturer of the ballast.

16. The method of claim 12, wherein the step of configuring takes place at a facility of a manufacturer of the ballast.

17. A method of providing to a customer a fluorescent dimming ballast having a desired ballast factor, the ballast adapted to drive a predetermined lamp type, the method comprising the steps of:

receiving a request for the ballast adaptable to be configured with the desired ballast factor;

providing the ballast;

using a ballast factor programming device to configure the ballast to have the desired ballast factor at a facility of a manufacturer of the ballast, the desired ballast factor substantially prevented from subsequently being adjusted; and subsequently shipping the ballast to the customer.

18. The method of claim 17, further comprising the steps of:

transmitting a digital signal to the ballast, the digital signal including the desired ballast factor; and storing the desired ballast factor in a memory of the ballast.

19. A method of providing to a customer a fluorescent dimming ballast having a desired ballast factor, the ballast adapted to drive a predetermined lamp type, the method comprising the steps of:

receiving a request for the ballast adaptable to be configured with the desired ballast factor;

shipping the ballast to the customer; and a field service personnel of a manufacturer of the ballast subsequently using a ballast factor programming device to configure the ballast to have the desired ballast factor at a facility of the customer, the desired ballast factor substantially prevented from subsequently being adjusted.

20. The method of claim 3, wherein the step of configuring is performed using a handheld remote control.

21. The method of claim 20, wherein the handheld remote control comprises a personal digital assistant executing a graphical user interface.

22. A method of providing to a customer a fluorescent dimming ballast having a desired ballast factor, the ballast adapted to drive a predetermined lamp type, the method comprising the steps of:

receiving a request for the ballast adaptable to be configured with the desired ballast factor;

shipping the ballast to the customer; and using a low-tech ballast factor adjustment procedure that does not require an advanced device to configure the ballast to have the desired ballast factor at a facility of the customer, the desired ballast factor substantially prevented from subsequently being adjusted.

23. A method of providing customer a fluorescent dimming ballast having a desired ballast factor the ballast comprising a replacement ballast, the ballast adapted to drive a predetermined lamp type, the method comprising the steps of:

receiving a request for the replacement ballast adaptable to be configured with the desired ballast factor;

shipping the replacement ballast to the customer;

removing an installed ballast;

installing the replacement ballast; and configuring the ballast to have the desired ballast factor at a facility of the customer by automatically determining the ballast factor, and storing the ballast factor in a memory of the replacement ballast;

wherein the desired ballast factor is substantially prevented from subsequently being adjusted.

24. The method of claim 23, wherein the step of configuring further comprises the steps of:

transmitting a digital signal to the ballast, the digital signal including the desired ballast factor; and storing the desired ballast factor in a memory of the ballast.

25. A method of providing to a customer a fluorescent dimming ballast having a desired ballast factor, the ballast adapted to drive a predetermined lamp type, the method comprising the steps of:

receiving a request for the ballast adaptable to be configured with the desired ballast factor;

providing the ballast;

using a ballast factor programming device provided by a manufacturer of the ballast to configure the ballast to have the desired ballast factor at a facility of an original equipment manufacturer, the desired ballast factor substantially prevented from subsequently being adjusted; and subsequently shipping the ballast to the customer.

26. An electronic dimming ballast for driving a gas discharge lamp, the ballast characterized by a ballast factor, the ballast comprising:

means for receiving an input representative of a desired ballast factor;

means for configuring the ballast to have the desired ballast factor, the desired ballast factor substantially prevented from subsequently being adjusted.

27. A method of configuring a ballast factor of a fluorescent dimming ballast, the method comprising the steps of:

receiving an input representative of a desired ballast factor; and configuring the ballast to have the desired ballast factor by transmitting a digital signal to the ballast, determining the desired ballast factor in response to the digital signal, and storing the desired ballast factor in a memory of the ballast;

wherein the desired ballast factor is substantially prevented from subsequently being adjusted.

28. The method of claim 27, further comprising the steps of:

coupling the ballast to a gas-discharge lamp;

controlling the lamp to a desired intensity; and determining the desired ballast factor in response to the desired intensity.

29. The method of claim 27, wherein the step of configuring further comprises using a handheld remote control to input the desired ballast factor, and the step of transmitting further comprises the handheld remote control transmitting the digital signal to the ballast.

30. The method of claim 29, further comprising the step of:

coupling the ballast to a digital communication link.

31. The method of claim 30, wherein the ballast comprises a replacement ballast.

32. The method of claim 31, further comprising the steps of:

coupling an installed ballast and a second control device to the digital communication link;

the second control device building a database of parameters of the installed ballast;

removing the installed ballast;

installing the replacement ballast;

the replacement ballast transmitting a query message to the second control device; and the second control device transmitting a ballast factor of the installed ballast to the replacement ballast;

wherein the step of storing further comprises storing the ballast factor of the installed ballast in the memory of the replacement ballast.

33. The method of claim 29, further comprising the step of:

executing a graphical user interface software on the handheld remote control.

34. The method of claim 33, further comprising the steps of:

using the graphical user interface software to input the desired ballast factor;

wherein the digital signal includes the desired ballast factor.

35. The method of claim 33, further comprising the step of:

entering a password prior to the step of the handheld remote control transmitting the digital signal to the ballast.

36. The method of claim 29, wherein the step of determining further comprises the ballast determining the desired ballast factor from the digital signal transmitted by the handheld remote control.

37. The method of claim 28, further comprising the steps of:

indicating to the ballast to configure the ballast factor; and subsequently storing the desired ballast factor in a memory of the ballast.

38. A method of configuring a ballast factor of a fluorescent dimming ballast, the method comprising the steps of:

receiving an input representative of a desired ballast factor; and using a ballast factor programming device to configure the ballast to have the desired ballast factor by transmitting the digital signal from the ballast factor programming device to the ballast;

wherein the desired ballast factor is substantially prevented from subsequently being adjusted.

39. The method of claim 38, further comprising the step of:

using a keypad of the ballast factor programming device to input the desired ballast factor;

wherein the digital signal includes the desired ballast factor.

40. The method of claim 38, further comprising the step of:

coupling the ballast and the ballast factor programming device to a digital communication link;

wherein the step of transmitting further comprises the ballast factor programming device transmitting the digital signal via the digital communication link.

41. The method of claim 38, further comprising the steps of:

coupling the ballast to a gas-discharge lamp; and the ballast controlling the lamp to a desired intensity in response to a digital signal.

42. The method of claim 41, further comprising the step of:

indicating to the ballast to configure the ballast factor;

wherein the ballast determines the desired ballast factor from the desired intensity.

43. The method of claim 39, further comprising the step of:

displaying the desired ballast factor on a visual display of the ballast factor programming device.

44. A method of configuring a ballast factor of a fluorescent dimming ballast the method comprising the steps of:

coupling the ballast to a gas-discharge lamp;

providing an input representative of a desired ballast factor to the ballast by controlling the lamp to a first intensity;

indicating to the ballast to configure the ballast factor by cycling power to the ballast a predetermined number of times after the step of controlling the lamp to the first intensity;

configuring the ballast to have the desired ballast factor by determining the desired ballast factor in response to the first intensity, and subsequently storing the desired ballast factor in a memory of the ballast;

wherein the desired ballast factor is substantially prevented from subsequently being adjusted.

45. The method of claim 44, wherein the predetermined number of times is three times.

46. The method of claim 44, further comprising the step of:

providing a plurality of levels of security prior to the step of indicating to the ballast to configure the ballast factor.

47. The method of claim 46, wherein the step of providing a plurality of levels of security further comprises the steps of:

controlling the lamp to a predetermined intensity; and subsequently cycling power to the ballast a predetermined number of times.

48. The method of claim 47, wherein the predetermined intensity is a minimum intensity of the ballast.

49. The method of claim 47, wherein the predetermined intensity is a maximum intensity of the ballast.

50. The method of claim 46, wherein the step of providing a plurality of levels of security further comprises the steps of:

disconnecting the lamp from the ballast; and subsequently reconnecting the lamp to the ballast.

51. An electronic dimming ballast for driving a gas discharge lamp, the ballast characterized by a ballast factor, the ballast comprising:

an inverter operable to convert a substantially DC bus voltage to a high-frequency AC voltage having an operating frequency and an operating duty cycle;

a resonant tank operable to couple the high-frequency AC voltage to the lamp to generate a present lamp current through the lamp;

a controller operable to control the inverter to control the current through the lamp;

a memory coupled to the controller and operable to store the ballast factor; and an input coupled to the controller and operable to receive a signal representative of a desired ballast factor;

wherein the controller is operable to store the desired ballast factor in the memory in response to receiving the signal representative of the desired ballast factor.

52. The ballast of claim 51, wherein the desired ballast factor is substantially prevented from subsequently being adjusted.

53. The ballast of claim 51, wherein the input comprises an infrared receiver operable to receive an infrared signal.

54. The ballast of claim 51, wherein the infrared signal includes the desired ballast factor.

55. The ballast of claim 54, wherein the input comprises a communication circuit adapted to be coupled to a digital communication link, and the controller is operable to transmit a query message via the digital communication link, the query message requesting the desired ballast factor.

56. The ballast of claim 55, wherein the controller is operable to receive a response message via the digital communication link, the response message including the desired ballast factor.

57. The ballast of claim 51, wherein the input comprises a communication circuit adapted to be coupled to a digital communication link and operable to receive a digital signal including the desired ballast factor.

58. The ballast of claim 57, wherein the digital signal includes the desired ballast factor.

59. The ballast of claim 51, wherein the controller is operable to control the inverter, such that the lamp is driven to a desired intensity.

60. The ballast of claim 59, wherein the controller is operable to determine the desired ballast factor in response to the desired intensity.

61. An electronic ballast characterized by a ballast factor and operable to drive a gas-discharge lamp in accordance with the ballast factor, the electronic ballast comprising:

an input adapted to receive a first ballast factor setting that represents a first desired ballast factor for the ballast and the lamp;

a memory adapted to store the first ballast factor setting; and a processor operable to use the first ballast factor setting stored in the memory to cause the ballast to provide the first desired ballast factor as the ballast drives the lamp.

62. The electronic ballast of claim 61, wherein the electronic ballast is a dimming ballast.

63. The electronic ballast of claim 61, wherein the lamp is a gas discharge lamp, a light emitting diode, or a high intensity discharge lamp.

64. The electronic ballast of claim 61, wherein the input is a communication port that receives signals over a communication link.

65. The electronic ballast of claim 61, wherein the input is operable to receive infrared signals or radio frequency signals.

66. The electronic ballast of claim 61, wherein the memory is an electronic erasable programmable read-only memory.

67. The electronic ballast of claim 61, wherein the input is adapted to receive a second ballast factor setting that represents a second desired ballast factor, wherein the second ballast factor setting replaces the first ballast factor setting in the memory, and further wherein the processor uses the second ballast factor setting stored in the memory to cause the ballast to provide the second desired ballast factor as the ballast drives the lamp or the ballast drives a different lamp.

68. The electronic ballast of claim 61, wherein the first desired ballast factor represents a ratio of actual light output of the ballast and the lamp combination to the rated light output of the lamp, and further wherein the ratio is less than, equal to, or greater than the rated light output of the lamp.

69. A method of configuring a ballast to provide a desired ballast factor when the ballast drives a lamp, the method comprising the steps of:

transmitting a first ballast factor setting to an input provided with the ballast, wherein the first ballast factor setting represents a first desired ballast factor for the ballast and a respective lamp;

storing the first ballast factor setting in a memory provided with the ballast; and processing the first ballast factor setting stored in the memory by a processor provided with the ballast to cause the ballast to provide the first desired ballast factor as the ballast drives the lamp.

70. The method of claim 69, wherein the first desired ballast factor represents a ratio of actual light output of the ballast and the lamp combination to the rated light output of the lamp, and further wherein the ratio is less than, equal to, or greater than the rated light output of the lamp.

71. The method of claim 69, wherein the electronic ballast is a dimming ballast.

72. The method of claim 69, wherein the step of transmitting further comprises transmitting the first ballast setting to the ballast over a communication link.

73. The method of claim 69, wherein the step of transmitting further comprises transmitting the first ballast setting to the ballast via infrared signals or radio frequency signals.

74. The method of claim 69, wherein the step of transmitting further comprises transmitting the first ballast factor setting to the ballast using a stand-alone device.

75. The method of claim 69, wherein the memory is an electronic erasable programmable read only memory.

76. The method of claim 69, further comprising the steps of:

transmitting a second ballast factor setting that represents a second desired ballast factor;

replacing the first ballast factor setting in the memory with the second ballast factor setting; and processing the second ballast factor setting stored in the memory to cause the ballast to provide the second desired ballast factor as the ballast drives the lamp or the ballast drives a different lamp.

77. A method of supplying a lighting fixture, the method comprising the steps of:

receiving by a first party a request from a customer for the lighting fixture having a ballast that provides a desired ballast factor;

assembling by the first party the lighting fixture provided with the ballast;

configuring the ballast with the desired ballast factor by transmitting, to an input provided with the ballast, a ballast factor setting representing the desired ballast factor for the ballast, and storing the ballast factor setting in a memory provided with the ballast; and supplying by the first party the lighting fixture with the configured ballast to the customer.

78. The method of claim 77, further comprising the step of:

receiving by the first party the lighting fixture without a ballast from a second party;

wherein the first party assembles the lighting fixture with the ballast and configures the ballast after the lighting fixture is received.

79. The method of claim 77, wherein the first party is a manufacturer of lighting fixtures.

80. The method of claim 77, wherein the first party is an original equipment manufacturer.

81. The method of claim 77, wherein the first party receives the ballast from a second party, and the first party configures the ballast after the ballast is received.

* * * * *